US012220740B2

(12) United States Patent
Yabuguchi

(10) Patent No.: US 12,220,740 B2
(45) Date of Patent: Feb. 11, 2025

(54) FASTENING TOOL

(71) Applicant: MAKITA CORPORATION, Anjo (JP)

(72) Inventor: Michisada Yabuguchi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 80 days.

(21) Appl. No.: 18/170,314

(22) Filed: Feb. 16, 2023

(65) Prior Publication Data

US 2023/0294162 A1 Sep. 21, 2023

(30) Foreign Application Priority Data

Mar. 16, 2022 (JP) ..... 2022-041923

(51) Int. Cl.
*B21J 15/26* (2006.01)
*B21J 15/10* (2006.01)
*B21J 15/02* (2006.01)

(52) U.S. Cl.
CPC ..... *B21J 15/26* (2013.01); *B21J 15/105* (2013.01); *B21J 15/022* (2013.01)

(58) Field of Classification Search
CPC . B21J 15/26; B21J 15/02; B21J 15/022; B21J 15/105
See application file for complete search history.

(56) References Cited

U.S. PATENT DOCUMENTS 10,483,901 B2 * 11/2019 Woyciesjes ..... B21J 15/26
10,994,325 B2 * 5/2021 Ikuta ..... F16B 19/08
11,007,565 B2 * 5/2021 Yabuguchi ..... B21J 15/045
11,065,674 B2 * 7/2021 Kawai ..... B21J 15/28
11,161,168 B2 * 11/2021 Yabunaka ..... B21J 15/043
11,185,913 B2 * 11/2021 Ikuta ..... B21J 15/022
2019/0013763 A1 * 1/2019 Woyciesjes ..... B21J 15/26
2019/0283110 A1 * 9/2019 Kawai ..... B21J 15/28
2019/0351477 A1 11/2019 Yabuguchi et al.
2021/0069773 A1 * 3/2021 Yabunaka ..... B21J 15/105
2021/0394253 A1 * 12/2021 Yabunaka ..... B21J 15/105
2021/0394254 A1 * 12/2021 Yabunaka ..... B21J 15/105

FOREIGN PATENT DOCUMENTS

WO 2018/131577 A1 7/2018

* cited by examiner

*Primary Examiner* — Gloria R Weeks
(74) *Attorney, Agent, or Firm* — Oliff PLC

(57) ABSTRACT

A representative fastening tool which fastens a work piece by utilizing a fastener that includes a pin in which a shaft portion and a head portion are integrally formed and a hollow shaped collar which is engageable to the pin, wherein the work piece is disposed between the head portion and the collar. The fastening tool includes a pin holding portion which can hold an end part region of the shaft portion, wherein the fastener is fastened in a state that the collar and the head portion clamp the work piece and the end part region is integral with the shaft portion, wherein the controller has the pin holding portion move in the first direction to conduct the fastening of the fastener by a motor drive control mode defined as a drive control of the motor based on motor drive current and motor drive electric power.

11 Claims, 15 Drawing Sheets

FASTENING TOOL

TECHNICAL FIELD

The disclosure relates to a fastening tool by utilizes a fastener, wherein the fastener includes a pin and a collar such that the pin comprises a shaft portion and a head portion integrally formed with the shaft portion and the collar has a hollow shape and the collar is engageable to the pin. The fastening tool fastens work piece disposed between the head portion and the collar.

BACKGROUND OF THE ART

With respect to the fastening operation of the work piece by the fastener as constructed above, several types of aspects are known as (1) fastening operation is completed wherein the end region of the shaft portion of the bolt is integral with the shaft portion, and (2) fastening operation is completed wherein the end region of the shaft portion is removed from the shaft portion.

According to the former aspect (1), because the fastening operation can be done without breaking the shaft portion, no additional process is necessarily required to re-coat coating material to the breaking area.

According to the latter aspect (2), because the broken end region of the shaft portion can be removed, total height of the fastener can be shortened after the completion of the fastening operation.

For example, WO 2018/131577 (hereinafter referred to as "patent reference 1") discloses a fastening tool regarding the fastener characterized by the above aspect (1).

According to this fastening tool disclosed in the patent reference 1, fastening operation is performed such that drive current for the motor is controlled to follow the reference current.

The fastening operation by utilizing the fastener of the above aspect (1), it is necessary to precisely control output during the fastening operation. Especially, it is required to maintain the end region of the shaft portion without being broken to remove when the fastening operation is performed. Therefore, in comparison with the aspect (2) as explained above, more precise output control is necessarily required.

In this connection, while patent reference 1 as explained above provides with one of solutions, further improvement for the output control is required.

PRIOR ART

Patent Reference

[Patent reference 1]
WO 2018/131577

SUMMARY OF THE INVENTION

Object of the Invention

Having regard to the above explained problem, it is an object of this disclosure to provide with a technique to further improve output control for the fastening operation.

Solution for Achieving the Object

Following fastening tool is provided to achieve the above explained object.

The representative fastening tool is provided to fasten a work piece by utilizing a fastener that includes a pin in which a shaft portion and a head portion are integrally formed and a hollow shaped collar which is engageable to the pin, wherein the work piece is disposed between the head portion and the collar.

The fastening tool comprises:

- a pin holding portion which can hold an end part region of the shaft portion, an anvil,
- a motor that drives the pin holding portion to move the pin holding portion relatively to the anvil in a predetermined longitudinal direction, and
- a controller that conducts drive control of the motor.

And the pin holding portion in a state to hold the end part region of the shaft portion relatively moves to the anvil in a predetermined first direction of the longitudinal direction and the anvil pushes the collar engaged with the shaft portion to fasten the fastener.

Thus, the fastener is fastened in a state that the collar and the head portion clamp the work piece and the end part region is integral with the shaft portion.

The controller has the pin holding portion move in the first direction to conduct the fastening of the fastener by a motor drive control mode defined as a drive control of the motor based on motor drive current and motor drive electric power.

The fastening operation according to this disclosure is also referred to as "swage". In order to fasten the fastener, strong output is required to plastically deform the collar. In this respect, following problem may possibly take place.

(1) Excessive Output

When the output is too high, strong force may possibly be applied to the bolt holding portion or the shaft portion of the bolt such that the apparatus may be broken.

(2) Dynamic Inertial Force of the Motor

According to a general working tool, there is a tendency to adopt high output typed motor in order to improve working capability. If such tendency is applied to the fastening tool, relatively high dynamic inertial force may possibly be generated when the high speed motor is decelerated or stopped and resultantly, high load may take place to the pin holding portion which holds the pin of the fastener such that protectability of the apparatus may adversely be affected.

These problems as (1) excessive output and (2) dynamic inertial force of the motor may especially become critical in a case that the fastening operation is done by using non-breaking typed fastener in which the end region of the shaft portion is integrally attached to the shaft portion when the fastening operation is completed.

According to the non-breaking typed fastener, the end region is not broken from the shaft portion when fastening and therefore, it is impossible to leave it on to have the pin holding portion relatively move to the rear position in the first direction.

In the fastening tool according to this disclosure, motor drive control mode is provided which is defined as a drive control of the motor based on motor drive current and motor drive electric power. Under the applying of the motor drive control mode, the controller has the pin holding portion move in the first direction to conduct fastening operation.

In such a case, above explained problem (1) excessive output can effectively be alleviated by the motor drive control mode.

Typically, the motor is driven by controlling such that the motor drive current does not exceed predetermined reference value and thus, excessive output can be alleviated.

Further, above explained problem (2) dynamic inertial force of the motor can effectively be alleviated by additional applying a control based on motor driving electric power.

Typically, the motor is drive by controlling such that the motor driving electric power does not exceed predetermined maximum reference value and thus, the number of rotations of the motor can be restricted within the necessary range.

As a result, in addition to the alleviation of the excessive output, the dynamic inertial force generated by the motor rotation can be kept at relatively low and excessive load can be prevented from being applied to the apparatus when the motor is decelerated or stopped.

As to the "motor" according to this disclosure, blushless motor may preferably be adopted due to its compact size and its relatively high output torque. Naturally, another typed motor can be adopted. Further, as to the means to supply electricity to the motor, DC battery attachable to the fastening tool may preferably be adopted. On the other hand, another typed electric source such like AC electric power can be used.

As to the "motor drive current", for example, current value at the motor drive circuit or output current value of the battery can be used.

As to the "motor driving electric power", because the electric power can be calculated by multiplication of current and voltage, for example, motor drive current value or voltage value calculated by the motor drive current can be used as a correlation value to the electric power.

Further, as to the "work material", it can be typically provided with multiple fastening objects each having a through hole. As the fastening object, materials made by metal are preferably be used due to the necessary fastening strength. Typically, combining multiple fastening objects such that trough holes are respectively aligned. Then, shaft portion of the bolt of the fastener is inserted into respective through holes such that head portion of the bolt is disposed at one end side of the through holes and the collar of the fastener is disposed at the other side of the through holes.

As to usage of the fastening tool according to this disclosure, it can be preferably used in a case that high fastening force is required such like in a manufacturing process of aircrafts or automobiles, or in disposing solar panels or plant factories.

As to the "pin holding portion" according to this disclosure, it can also be provided with multiple claws (also referred to as "jaws") each of which can engage with the end region of the shaft portion.

As to the "anvil" according to this disclosure, it is preferrable to provide with a metal base to deform the collar by fastening force to have a bore hole (opening hollow portion) with a taper portion in order to receive an outer part of the collar.

As for its specific aspect, the diameter of the bore may preferably be smaller that the outer diameter of the fastening region of the collar, while the opening of the taper portion formed at the bore may preferably be larger than the outer diameter of the fastening region of the collar such that the collar is introduced into the bore. By such construction, when the bolt holding portion relatively moves to the anvil in the fastening direction, the anvil contacts with the opening of the taper portion to push the collar in the longitudinal direction such that the collar is pressed by the taper portion by the further relative movement and received further into the bore of the anvil.

As a result, the collar clamps the work pieces between the collar and the head portion and then, the collar is compressed in the radial direction and is transformed to decrease the diameter by the bore of the anvil. Thus, the hollow portion of the collar is press-fit to the shaft portion and the collar is fastened to the bolt and the work pieces are fastened.

When the fastener is fastened, the collar is plastically deformed. Therefore, in comparison with other tools or other electric apparatus such like consumer electrics, relatively strong output is required and thus, device protection against such strong output is necessarily required.

Especially, such requirement is remarkable when non-breaking typed fastener is used.

According to the fastening tool according to this disclosure, the motor drive control mode is arranged to control the motor drive based the drive current and the electric power for the motor. As a result, device protection can be secured especially against (1) exceeded output and (2) dynamic inertia force of the motor.

Effect of the Invention

According to this disclosure, a fastening tool which further improves the output control for the fastening operation is provided. Especially, this technique is effective in a case that a fastener is used such that the shaft portion of the bolt and its end region are integral without being separated when the fastening operation is finished.

EMBODIMENT TO EXPLOIT THE INVENTION

Figure 1:
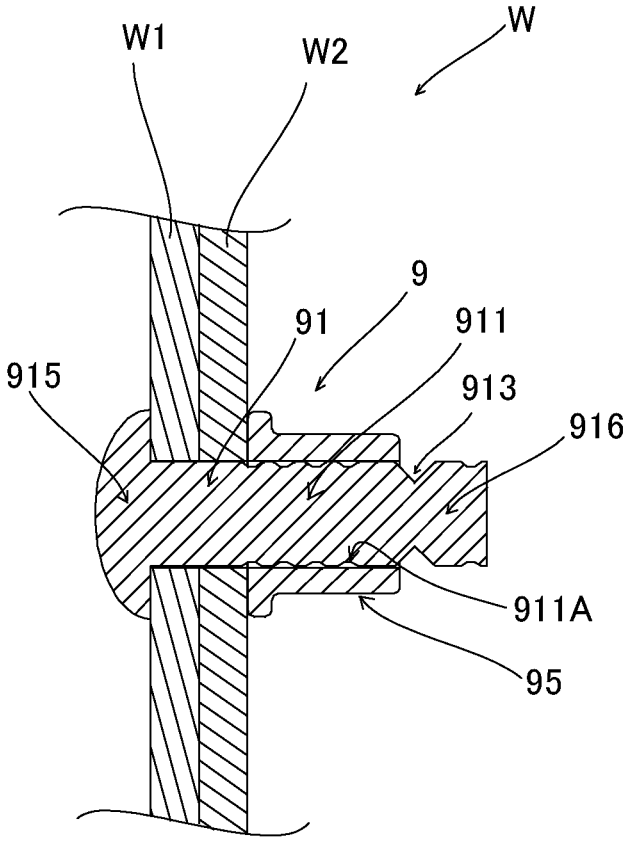
FIG. 1 shows an example of the fastener (end portion non-breaking type) which can be used by the fastening tool according to this disclosure.

With respect to the fastening tool according to this disclosure, it is preferable that the controller conducts the drive control of the motor in the motor drive control mode such that first reference value regarding the drive current of the motor is equal or less that a predetermined first upper limit value, while second reference value is equal or less than a predetermined second upper limit value.

According to this disclosure, the first upper limit value corresponds to a reference value for the motor drive current limit control. And the second upper limit corresponds to a reference value to control for the electric power value to drive the motor.

By controlling the motor drive current and the electric power not to exceed the predetermined reference values (in a restricted manner), an adverse affection due to the excessive output of the motor and the dynamic inertial force of the motor can be effectively alleviated.

As to the first reference value regarding the motor drive current, current value supplied by the battery can be adopted instead of the motor drive current as itself. Further, voltage value reflecting the motor drive current can be used the first reference value.

As to the second reference value, regarding the motor drive current, current value supplied by the battery can be adopted instead of the motor drive current as itself. Further, voltage value reflecting the motor drive current can be used the first reference value.

The fastening tool may preferably be arranged such that at least one of the first upper limit value and the second upper limit value is changeable by a manual operation of the user.

Typically, rotatable operation dial or numeric key pad and so on can be adopted in which the user can freely manually input and change the reference value.

For example, the reference value can be manually inputted in accordance with the require strength for the fastening force, working material and other working circumstances at least one of the first upper limit value and the second upper limit value.

The fastening tool may preferably be arranged such that the second upper limit value is set to correspond to inertia force of the motor in the fastening operation.

As explained above, the dynamic inertial force caused by the rotation of the motor may adversely affect unfavorable load to the apparatus when the motor is decelerated or stopped.

Therefore, the second reference value against such inertial force of the motor is provided.

According to this disclosure, the motor is controlled such that the second reference value regarding the electric power to drive the motor is equal or less than the second upper limit value and thus, apparatus protectability can be further improved.

The fastening tool may preferably be arranged such that the controller calculates the first reference value and the second reference value as voltage values.

By such construction to handle both reference values as voltage, simplified system can be provided.

The fastening tool may preferably be arranged such that the controller calculates the first voltage output value with respect to the motor drive current such that the first reference value is equal to or less than the first upper limit value so as to set the second reference value based on the first voltage output value, wherein the controller calculates the second upper limit value as voltage value based on the motor drive current so as to control the motor drive such that the second reference value is equal to or less than the second upper limit value.

By such construction, the drive control based on the motor drive current is done first, and then, the drive control based on the electric power is done and as a result, motor drive control can be entirely streamlined.

The fastening tool may preferably be arranged such that the motor is defined by a blushless motor, wherein the controller calculates the second voltage value such that the second reference value is equal to or less than the second upper limit value and calculates the PWM duty ration to drive the motor based on the second voltage output value.

By such construction, while high torque with relatively compact body can be provided due to the adoption of the brushless motor, such brushless motor can be appropriately controlled by the motor drive control mode according to this disclosure.

The fastening tool may preferably be arranged such that the controller drives the pin holding portion by the motor drive control mode from the start of the fastening operation till to the completion of the fastening operation.

By such construction, the motor output control can be made from the initial stage of the fastening operation.

The fastening tool may preferably be arranged such that the controller drives the pin holding portion by the motor drive control mode from the start of the fastening operation till to predetermined time passing.

By such construction, usual motor drive control is made till predetermined time passes from the start of the fastening operation and thereafter, the motor drive control according to this disclosure is made.

By such combination, both shortening of the working time and the protection of the apparatus can be balanced.

The fastening tool may preferably be arranged such that, if the state of the pin holding portion before moving in the first direction is defined as an initial position, the controller includes a return trip in which the pin holding portion after completion of the fastening operation is moved back to the initial position, wherein, in the return trip, the motor drive control mode is not applied for the motor drive.

By such construction, apparatus protectability can be improved in the forward trip by applying the motor drive control mode, while necessary time to return to the initial position for the next fastening operation can be shortened by not applying the motor control mode in the reverse trip. Thus, stroke time for the fastening operation can be rationally shortened.

The fastening tool may preferably be arranged such that the controller stops the driving of the pin holding portion in a case that the reference regarding the number of rotations of the motor is equal to or less than the predetermined value to complete the fastening operation.

In a case that so-called non-breaking typed fastener is used, the end region of the shaft portion is not broken to be separated during the fastening operation and therefore, another definition (detection) is necessarily required for completing the fastening operation. In this respect, by adopting a reference regarding the number of rotations of the motor, the completing of the fastening operation can securely be detected.

Note that "the number of rotations of the motor is equal to or less than the predetermined value" may also comprise the aspect that the motor is stopped and the number of rotations become zero.

The fastening tool may preferably be arranged such that the fastening tool is arranged that when the fastener is defined as a first fastener, further a second fastener is defined to have a pin in which a shaft portion and a head portion is integrally formed and a hollow shaped collar which is engageable to the pin, wherein a end part region of the shaft portion is separatable from the shaft portion, wherein the fastening tool can fasten a workpiece disposed between the head portion and the collar and wherein, the pin holding portion conducts the fastening of the second fastener in a state that the end part region is separated from the shaft portion.

While the first fastener is defied as a non-breaking typed, the second fastener is defined as breaking typed (separate type).

Accordingly, the fastening tool according to this disclosure is defined as a dual typed machine (compatible machine) to which both the first fastener and the second fastener can be used.

As a result, the fastening tool can become more useful.

Hereinafter, in reference of drawings, representative and non-restrictive embodiment is specifically explained. In the following embodiment, a fastening tool 1 which can fasten working material by utilizing a fastener is exampled.

Figure 2:
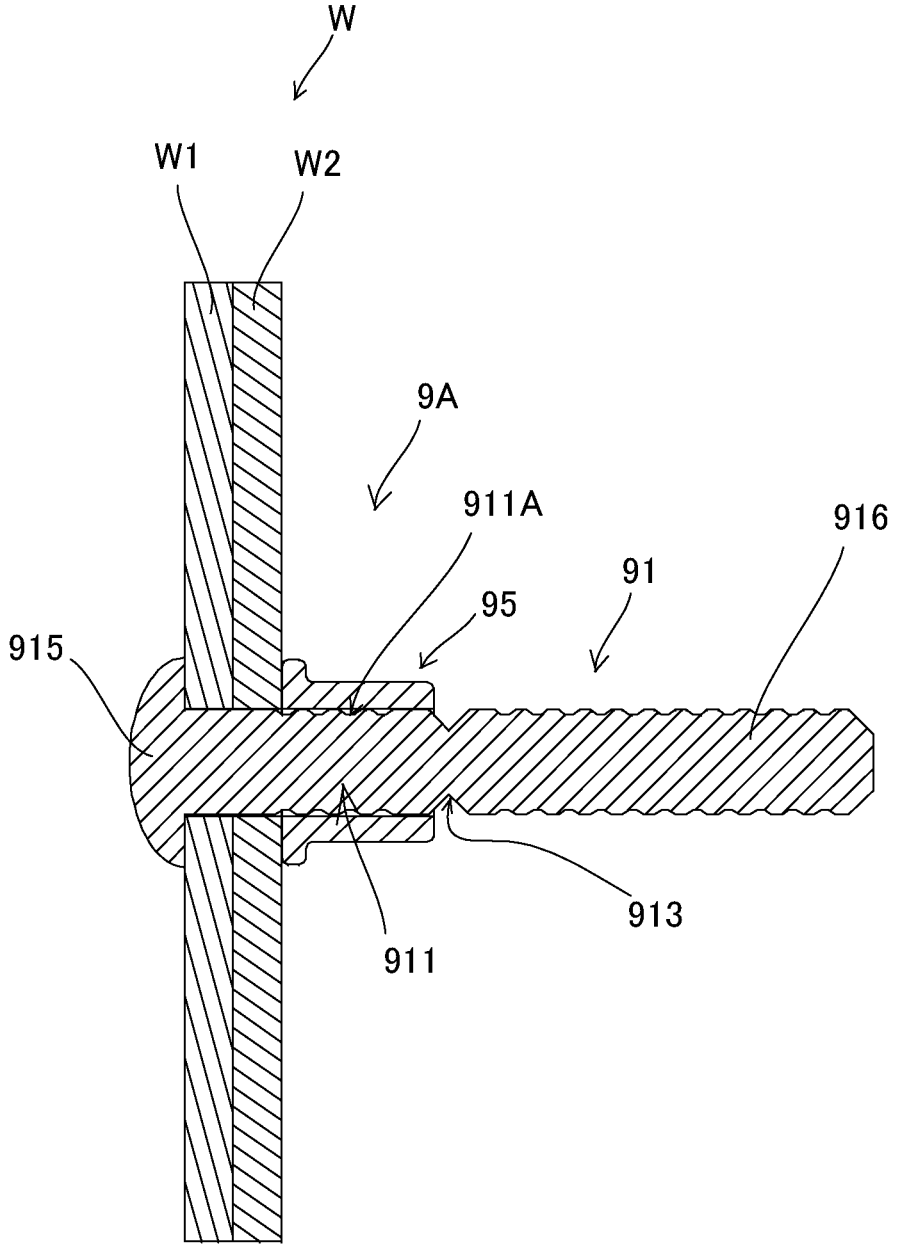
FIG. 2 shows an example of the fastener (end portion breaking type) which can be used by the fastening tool according to this disclosure.

The fastening tool 1 is able to selectively utilize plurality types of fasteners. Fastener 9, 9A as respectively shown in FIG. 1 and FIG. 2 are examples of fasteners utilizable by the fastening tool 1.

In greater detail, each of fasteners 9, 9A is an example of fastener for fastening multiple component parts.

As to the fastener for fastening multiple work pieces, there are two types:

One is non-breaking typed fasteners in which the shaft portion of the pin is non-broken and kept as such.

The other is breaking typed fasteners in which the shaft portion of the pin is partly broken to be separated.

The fastener 9 as shown in FIG. 1 is a non-breaking typed fastener. The fastener 9 comprises a pin 91 and a collar 95.

The pin comprises a shaft portion 911 and a head portion 915 integrally formed with the shaft portion 911 at one end of the shaft portion 911.

The shaft portion 911 is provided with a groove 911A which can engage with the collar 95 and with a small diameter portion 913 to be held by a pin holding portion 165 (see FIG. 4) which will be explained later.

The collar 95 is formed as a cylindrical member to which the shaft portion 911 can be inserted.

The pin 91 and the collar 95 are respectively formed independently and the, integrally combined.

When the fastener 9 is applied to the fastening tool 1, the pin 91 is pulled to the collar 95 in the longitudinal direction and the collar 95 is plastically deformed. As a result, the head portion 915 of the pin 91 and the collar 95 fastened to the shaft portion 911 of the pin 91 clamp the working piece W (Working piece material W1 and W2 as fastening objects).

On the other hand, the fastener 9A as shown in FIG. 2 is a breaking typed fastener. While the basic structure of the fastener 9A is the same with the one of the fastener 9, the pin 91 of the fastener 9A is formed relatively longer in the longitudinal direction. On the shaft portion 911, a groove 911A engageable with the collar 95 and a small diameter portion 913 to be held by the pin holding portion 165 (see Fi. 4) and to be broken.

Hereinafter, schematic structure of the fastening tool 1 according to this embodiment is explained.

Figure 3:
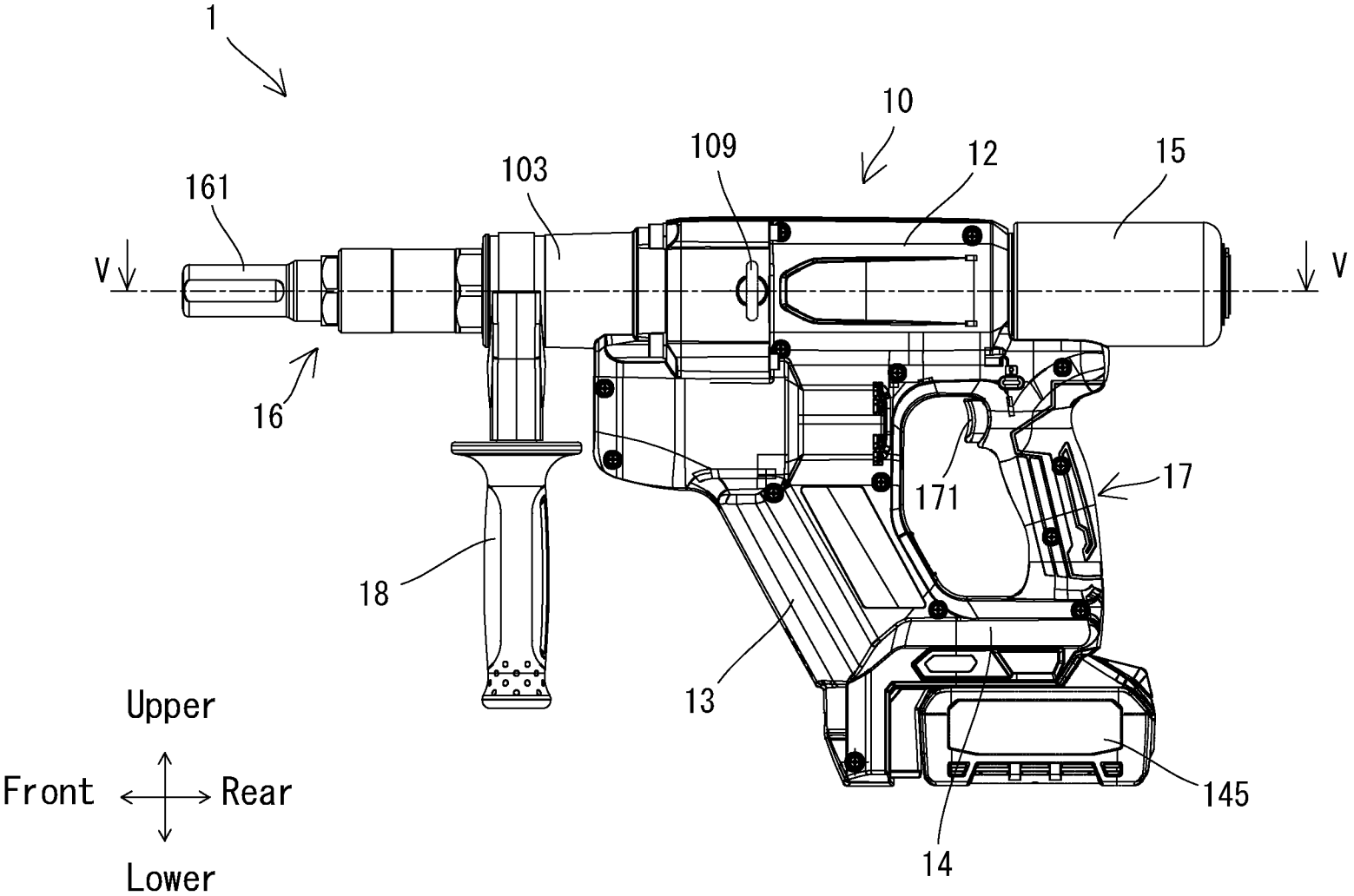
FIG. 3 shows a left side view of the fastening tool to which an auxiliary handle is attached.
Figure 4:
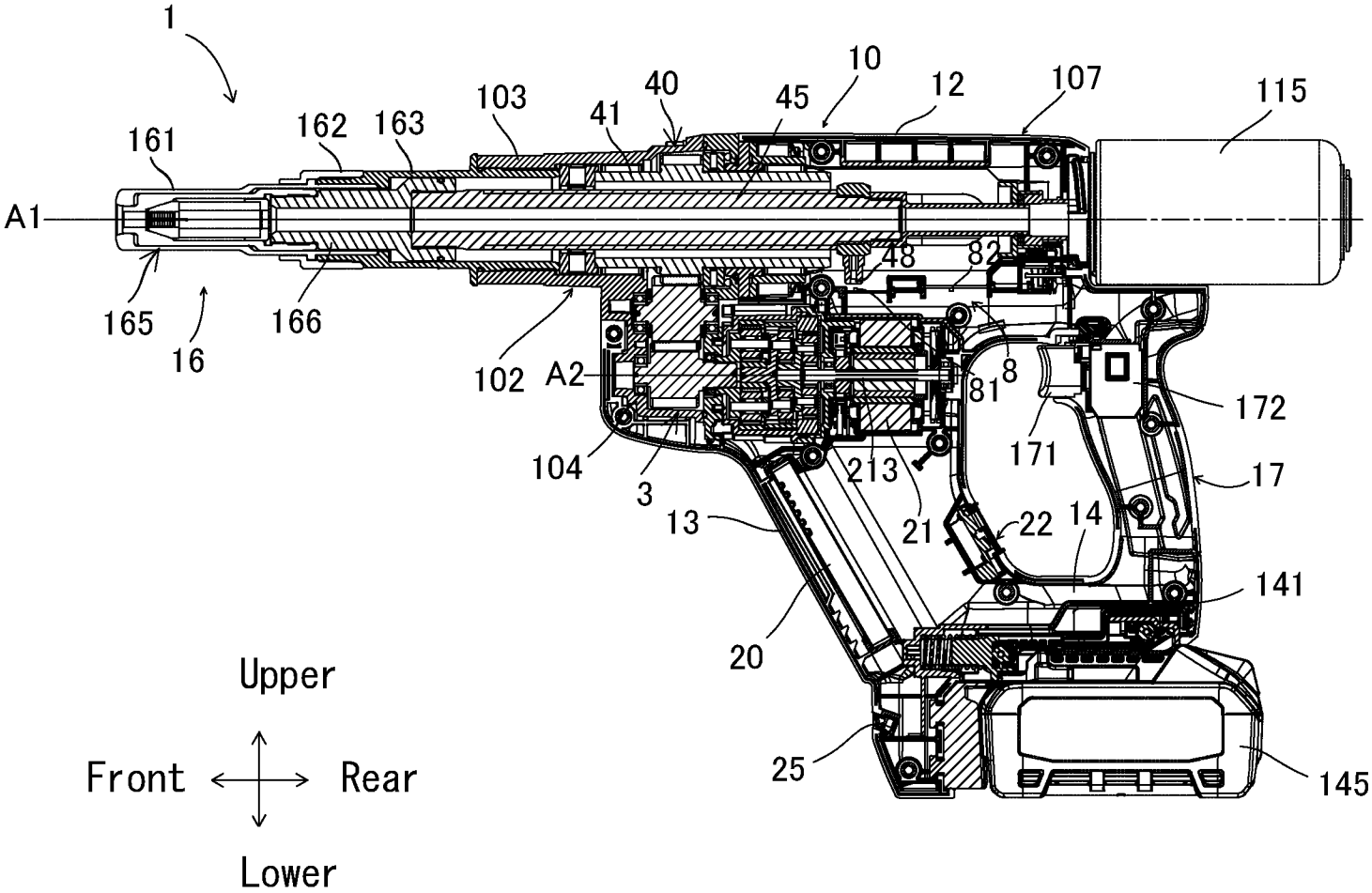
FIG. 4 shows a cross sectional view of the fastening tool in which the screw shaft and the pin holding portion are disposed at the initial position.

As shown in FIG. 3 and FIG. 4, the fastening tool 1 comprises a tool housing 10, a nose 16 and a handle 17.

The tool housing 10 is also referred to as "housing". The tool housing 10 houses a motor 21 and a drive mechanism 3 and so on. A battery 145 is attachable to the tool housing 10 and the fastening tool 1 is driven by electric power supplied by the battery 145.

The nose 16 comprises an anvil 161 and a pin holding portion 165 disposed in the anvil 161.

The anvil 161 is connected with one end of the tool housing 10 so as to extend in a predetermined drive axis A1.

The extending direction of the drive axis Al coincides with the longitudinal direction according to this disclosure.

The handle 17 is provided with an elongated cylindrical body held by the user of the fastening tool 1.

The handle 17 is disposed at the opposing side to the anvil 161 in the extending direction of the drive axis A1. The handle extends in the direction crossing the drive axis A1 (substantially perpendicular to the drive axis A1).

The handle is provided with a trigger 171 pulled by the user (pulling operation). As shown in FIG. 4, the trigger is connected with an electrical switch 172 turned on by the pulling operation of the trigger 171 to generate trigger on signal.

In this embodiment, both ends of the handle 17 are connected with the tool housing 10 having substantially C shape. The tool housing 10 and the handle 17 entirely form substantially D shaped ring portion.

When the user has the fastener 9 (see FIG. 1) or the fastener 9A engage with the front end portion of the anvil 161 and conducts pulling operation of the trigger 171, the motor 21 is started.

Thereby, the drive mechanism 3 strongly rearwardly pulls the pin 91 to the collar 95 by the pin holding portion 165 which holds the small diameter portion 913 of the shaft portion 91. As a result, the fastener 9 (or the fastener 9A) is deformed and the working piece W (W1 and W2) is fastened.

Hereinafter for the sake of convenience, with respect to directions of the fastening tool 1, the extending direction of the drive axis A1 is defined as front-rear direction of the fastening tool 1.

The front-rear direction coincides with the longitudinal direction in this disclosure.

With respect to the front-rear direction, the side at which the nose 16 is disposed is defined as front side, while the other side as rear side (side at which the handle 17 is disposed).

The rear side coincides with the first direction and the front side coincides with the second direction according to this disclosure.

Further, the direction perpendicular to the drive axis A1 and to correspond to the longitudinal direction of the handle 17 is defined as upper-lower direction.

With respect to the upper-lower direction, the end side close to the drive axis A1 of the handle 17 is defined as upper side, while the other side (remote side from the drive axis A1) as lower side.

Further, the direction perpendicular both to the front-rear direction and the upper-lower direction is defined as right-left direction.

Hereinafter, structure of the fastening tool 1 is explained in detail.

As shown in FIG. 3 and FIG. 4, the tool housing 10 comprises a housing part 12, an extending portion 13 and a battery holding portion 14.

The housing part 12 extends in the drive axis A1. A front-end region of the upper part of the housing part 12 (hereinafter referred to as "barrel portion 103") is cylindrically shaped. An auxiliary handle 18 is attachable around at the front-end region of the barrel portion 103.

The extending portion 13 extends obliquely to the rear lower side from the lower end of the housing part 12 within the tool housing. 10.

The battery holding portion 14 extends rearwardly from the center region of the extending portion 13 in the upper-lower direction. The battery holding portion 14 is arranged such that the battery 145 can be detachably held.

Note that, in this embodiment, the battery 145 is attached to the battery holding portion 14 by means of a battery holder 141 held by the battery holding portion 14. Instead of that, the battery holding portion 14 may directly hold the battery 145.

As shown in FIG. 4, the motor 21, the drive mechanism 3 and a position detecting mechanism 3 are mainly housed within the tool housing.

The motor 21 is housed at the lower rear region of the housing part 12. In this embodiment, DC blushless motor is adopted for the motor 21.

A rotation axis A2 of the motor shaft 213 extends in the front-rear direction parallel to the drive axis A1 at the lower side of the drive axis A1. The motor shaft 213 is rotatable both forwardly and reversely. The forward drive of the motor shaft 213 corresponds to the direction to have the ball shaft 45 and the pin holding portion 165 move rearward. On the other hand, the reverse drive of the motor shaft 213 corresponds to the direction to have the ball shaft 45 and the pin holding portion 165 move forward.

The drive mechanism 3 is driven by the motor 21. The drive mechanism 3 have the pin 91 of the fastener 9 (or the fastener 9A shown in FIG. 2) relatively move in the front-rear direction to the collar 95. In detail, the drive mechanism has the pin holding portion 165 to hold the pin 91 move to the anvil 161 connected to the tool housing 10 along with the drive axis A1.

Figure 5:
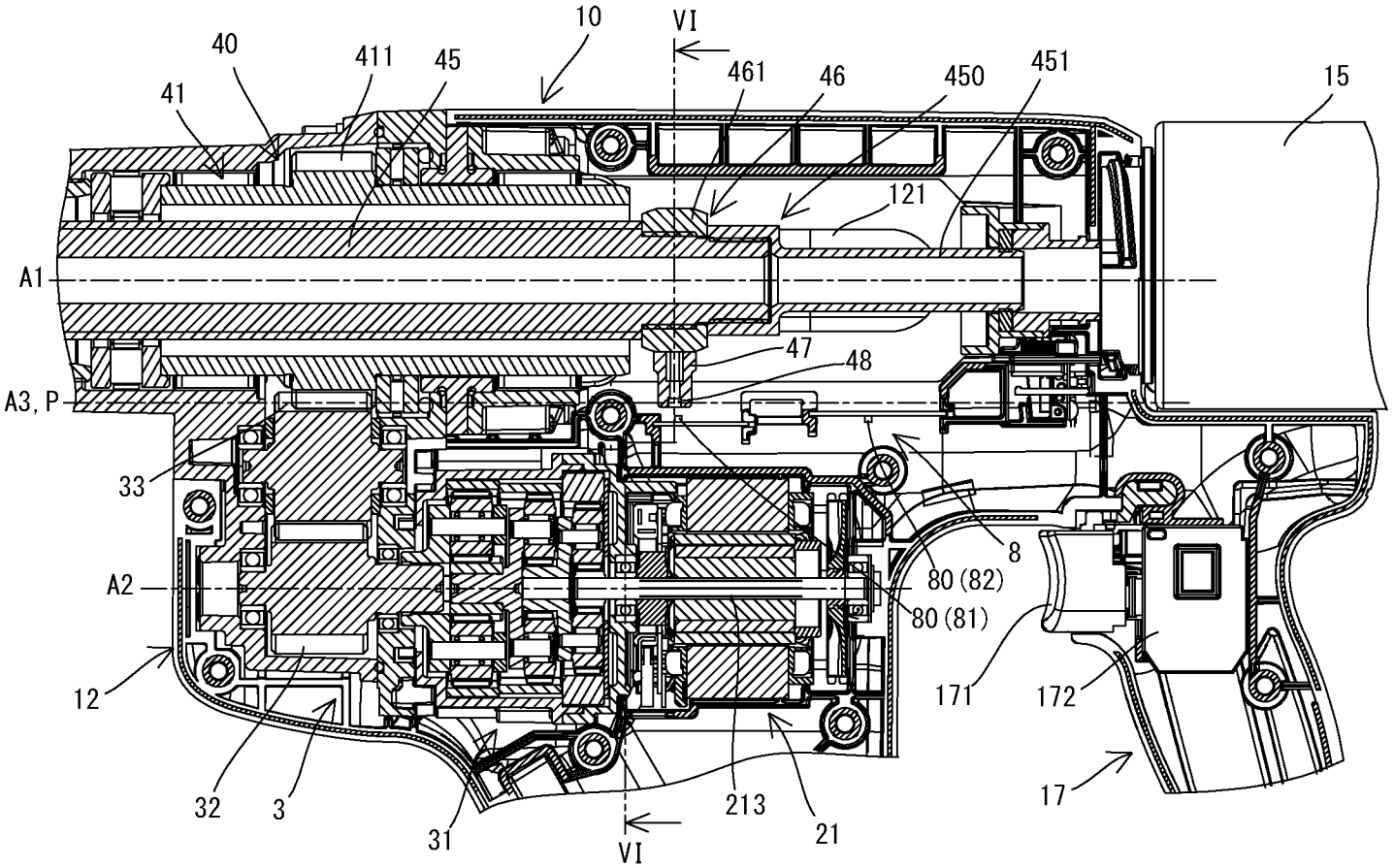
FIG. 5 shows an enlarged view of FIG. 4.

As shown in FIG. 5, the drive mechanism 3 of this embodiment comprises a planetary speed reduction mechanism 31, a drive gear 32, an idling gear 33 and a ball screw mechanism 40.

The planetary speed reduction mechanism 31 is disposed in the housing part 12 at the front of the motor 21 to be coaxial with the motor 21. The planetary speed reduction mechanism 31 is arranged as a multistage type.

The drive gear 32 is disposed coaxially with the planetary speed reduction mechanism 31 in front of the planetary speed reduction mechanism 31.

The planetary speed reduction mechanism 31 is arranged to amplify the torque transmitted from the motor shaft 213 to rotate the drive gear 32.

The idling gear 33 is disposed on the upper side of the drive gear 32. The idling gear 33 engages with the drive gear 32 and a driven gear 411 of a nut 41.

The ball screw mechanism 40 is arranged to convert the rotational movement to the linear movement as one of a motion converting mechanism.

In this embodiment, the ball screw mechanism 40 converts the rotation of the nut 41 to the linear movement of the screw shaft 45 to have the pin holding portion 165 linearly move.

The ball screw mechanism 40 mainly comprises the nut 41 and the screw shaft 45 and is disposed on the upper region of the housing part 12.

The nut 41 is held by the tool housing 10 substantially unmovably in the front-rear direction and rotatably around the drive axis A1.

The nut 41 has a cylindrical shape and comprises the drive gear 411 integrally provided around the outer circumference.

The nut 41 is held by two bearings respectively held by the tool housing 10 at the front side and at the rear side of the driven gear 411.

The screw shaft 45 is engaged with the nut 41 such that the screw shaft 45 is substantially un-rotatable around the drive axis A1 and movable in the front-rear direction along the drive axis A1.

In greater detail, the screw shaft 45 is formed as an elongated body and is inserted to the nut 41 to extend along the drive axis A1.

While detailed indication in the drawing is abbreviated, a spiral orbit is formed by grooves respectively provided with the inner circumferential face of the nut 41 and with the outer circumferential face of the screw shaft 45. Multiple balls are disposed on the orbit in a rollable manner.

The screw shaft 45 is engaged with the nut 41 by means of these balls. An extended shaft 451 is coaxially connected to be secured at the front end region of the screw shaft 45 and thus, the extended shaft 451 is integral with the screw shaft 45. Hereinafter, the integrated screw shaft 45 and the extended shaft 451 are also referred to as drive shaft 450.

The drive shaft 450 comprises an insertion hole which penetrates the drive shaft 450 along the drive axis A1.

A collecting container 15 is detachably attached at the front end region of the tool housing portion 911 detached from the pin 91 of the fastener 9 (herein after referred to as "pin tail"). The end part region 916 corresponds to the end side region from the small diameter portion 913 of the shaft portion 911 to be broken and separated from the pin 91.

The pin tail separated from the fastener 9 passes through the penetration hole of the drive shaft 450 and reaches the collecting container 15 to be restored.

Thus, when the fastener 9A as shown in FIG. 2 is used, the separated pin tail is collected by the collecting container 15.

Figure 6:
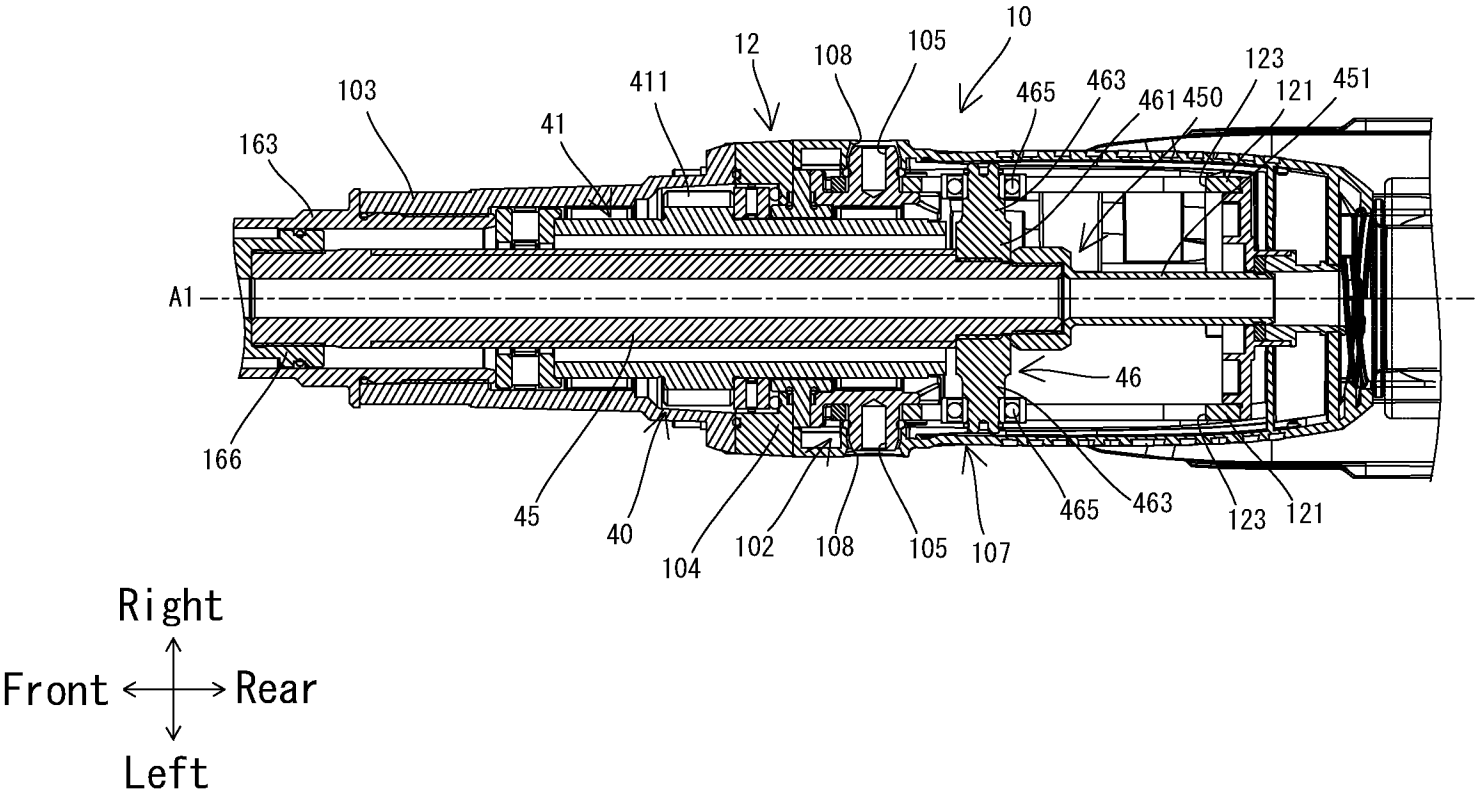
FIG. 6 shows a partial cross-sectional view at V-V line in FIG. 3.
Figure 7:
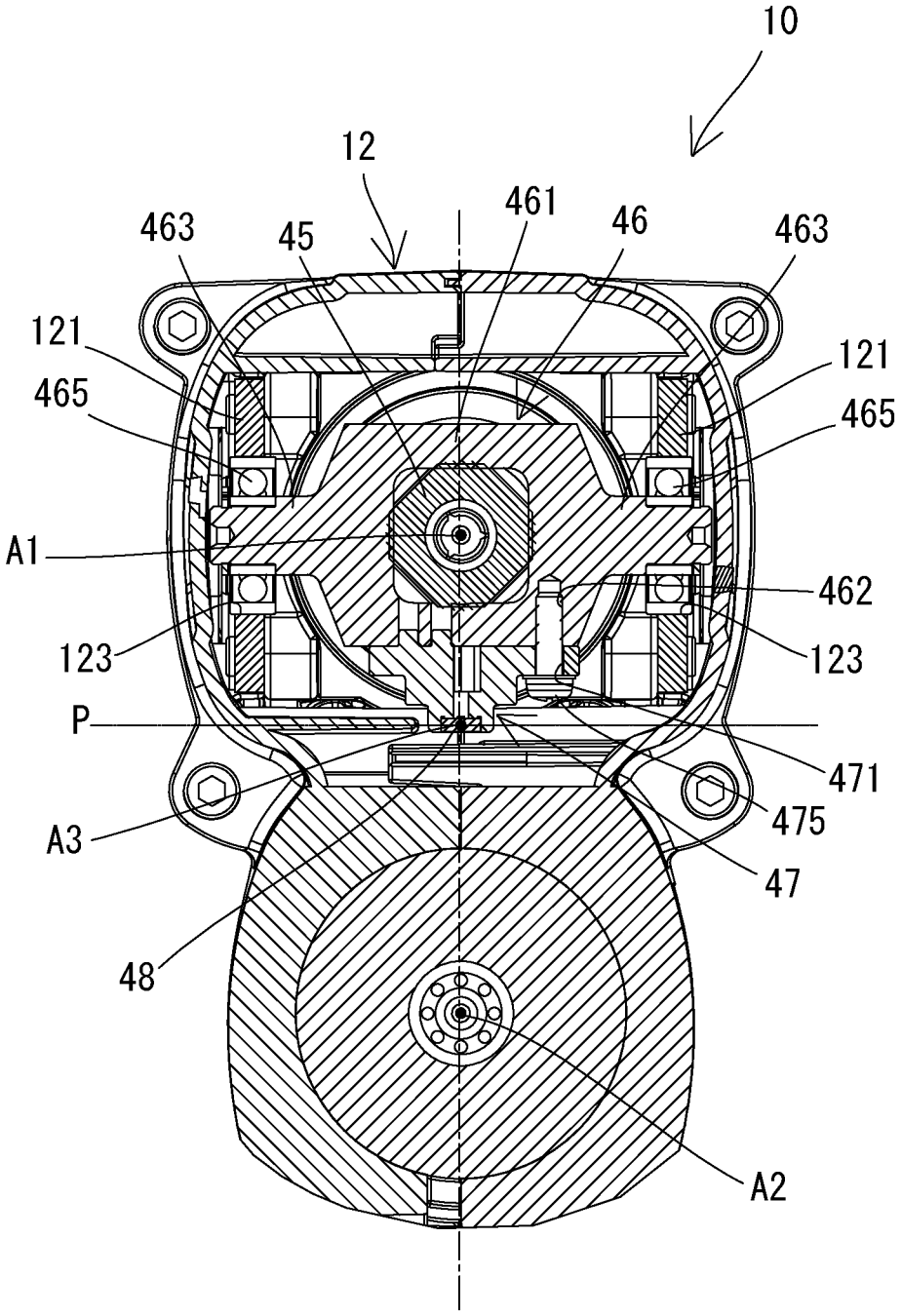
FIG. 7 shows a partial cross-sectional view at VI-VI line in FIG. 5.

Further, as shown in FIGS. 5 to 7, a bearing holder 46 is connected at the front end region of the screw shaft 45.

The bearing holder 46 comprises a base portion 461 disposed around the circumference of the screw shaft 45 and two arm portions 463, 463 respectively extending rightward and leftward from the base portion 461.

The base portion 461 is disposed between the rear face of the shoulder part at the rear end region of the screw shaft 45 and the front end face of the extended shaft 451. The base portion 461 is fixedly connected with the screw shaft 45.

Thus, the bearing holder 46 is integrally formed with the screw shaft 45 (drive shaft 450).

A bearing 465 is disposed at each front end part of the arm portions 463, 463.

On the other hand, right-left paired guide plates 121, 121 are secured to the tool housing 10 (housing part).

Each of the guide plates 121, 121 is provided with a guide groove 123 extending in the front-rear direction.

Each of the right and left bearings 465 is disposed in each of the right and left guide groove 123.

Due to such construction, when the nut 41 is rotated around the drive shaft Al in relation to the drive of the motor 21, the screw shaft 45 is linearly moved to the nut 41 and to the tool housing 10 in the front-rear direction.

Further, as shown in FIG. 5 and FIG. 7, a magnet holder 47 is connected to the lower end region of the bearing holder 46. The magnet holder 47 defines a holding member of the magnet 48.

The magnet holder 47 is disposed at the lower side of the bearing holder 46 and comprises a penetration hole 471 which penetrates the magnet holder 47 in the upper-lower direction.

At the lower end region of the bearing holder 46 (base portion 461), a screw hole 462 extending in the upper-lower direction. A screw 475 is fastened to the screw hole 462 by the penetration hole 471 from the lower side of the magnet holder 47.

By such construction, the magnet holder 47 and the magnet 48 are fixedly connected with the bearing holder 46 and integrated with the screw shaft 45 (drive shaft 450) via the bearing holder 46.

The magnet holder 47 holds the magnet 48 such that the magnet 48 is exposed to the lower side.

The magnet holder 47 is integrated with the screw shaft 45 and thus, the center of the magnet 48 moves in the front-rear direction along a moving axis A3 which parallel to the drive shaft Al as the screw shaft 45 moves in the front-rear direction along the drive axis A1.

The position detecting mechanism 8 as shown in FIG. 5 is a mechanism which detects magnetic field by the magnet 48 to detect position of the screw shaft 45 and thus, the position of the pin holding portion 165.

In this embodiment, the position detecting mechanism 8 comprises two magnetic sensors 80, 80 (a first sensor 81 and a second sensor 82) respectively disposed away from each other in the front-rear direction in the vicinity of the moving axis A3 of the magnet 48.

The detecting result of the magnet sensor 80 is utilized for the drive control of the motor and the movement control of the pin holding portion 165. Note that the first sensor 81 defines the initial position detecting sensor for the pin holding portion 165, while the second sensor 82 defines the rear end position detecting sensor for the pin holding portion 165.

As shown in FIG. 4, the controller 20 is disposed in the extending portion 13.

The controller 20 is, while not particularly shown in drawings, formed in a housing structure to house circuit substrate and defines a component element of the motor drive control mechanism 200 which will be explained later.

The controller 20 is electrically connected with the magnetic sensor 80 (the first sensor 81 and the second sensor 82), the LED light 25 and the switch 172. The controller controls the movement of the fastening tool 1 including the drive control of the motor 21.

Further, as shown in FIG. 4, the extending portion 13 is provided with an operation dial 22 at the side to opposed to the controller 20, in other words at the side to face to the trigger 172.

Figure 8:
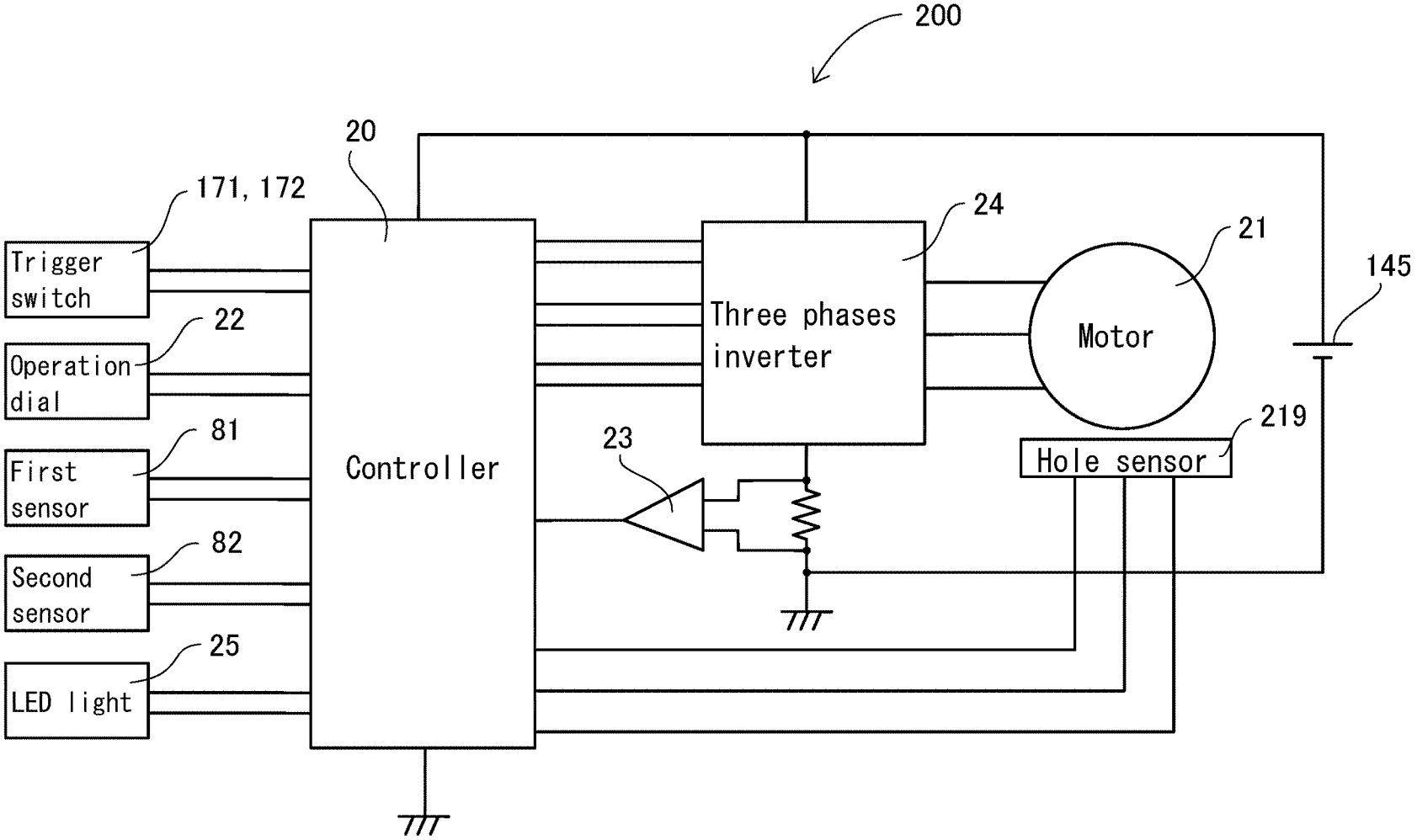
FIG. 8 shows a block diagram schematically indicating the structure of the motor drive control mechanism in the fastening tool according to this disclosure.

Further, the fastening tool 1 according to this embodiment is arranged to be a dual-purpose machine wherein the non-breaking typed fastener 9 as shown in FIG. 8 and the breaking typed fastener 9A as shown in FIG. 2 are both able to be used.

The operation dial 22 is arranged that the user can manually input which one is used for the fastening operation, the non-breaking typed fastener 9 or the breaking typed fastener 9A.

Further, when the non-breaking typed fastener 9 as shown in FIG. 1 is used, upper limit reference values can be inputted as to the drive current and the electric power to drive the motor 21. This aspect will be explained later.

Further, the LED light 25 is disposed at an opening portion formed in the front wall of the extending portion 13. The LED light 25 is arranged to illuminate the front region of the nose 16 (namely, region of the fastening operation).

Further, as shown in FIG. 4 and FIG. 6, the tool housing 10 comprises a metal housing 102 and a resin housing 107.

The metal housing 102 is made by metal (for examp001e, aluminum alloy) to comprise a barrel 103 and a holding portion 104 to hold the drive gear 32, idling gear 33 and the nut 41.

The resin housing 107 is made by resin and is fixedly connected to the metal housing 102 in an integrated manner. The resin housing 107 coves most part of the holding portion 104 of the metal housing 102.

As shown in FIG. 6, a screw holes 105, 105 are formed at the right and left sides of the region holding the nut 41 with respect to the holding portion 104 of the metal housing 102.

Openings 108, 108 are formed at the right wall portion and the left wall portion of the resin housing 107 to expose the screw hole 105 to the outside.

An eyebolt 109 can be connected to each of the screw holes 105, 105 as shown in FIG. 3 and FIG. 6.

The fastening tool 1 can be suspended by the user by an attachment shoulder belt connected with the loop of the eyebolt 109.

Hereinafter, the structure of the nose 16 is explained. As shown in FIG. 4, the nose 16 mainly comprises the anvil 161 and the pin holding portion 165. Note that the constructions of the anvil 161 and the pin holding portion 165 are pertaining to known art and therefore, only brief explanation is made.

The anvil is generally in a cylindrical shape and comprises a bore extending along the drive axis A1.

The front region of the bore is arranged to have smaller diameter than other parts and can contact (engage) with the collar 95 of the fastener 9.

The anvil 161 is connected with the tool housing 10 (barrel portion 103) via the connecting portion 162, 163.

The pin holding portion 165 is arranged to hold the pin 91 (shaft portion 911) of the fastener 9 and to move to the anvil 161 in the front-rear direction along the drive axis A1.

In greater detail, the pin holding portion 165 is slidably held in the bore coaxially with the anvil 161.

The pin holding portion 165 is also called as "joe assembly" to comprise multiple claws each of which can hold the shaft portion 911 of the pin 91.

As the pin holding portion 165 moves to the anvil 161 from the initial position (position as shown in FIG. 3) to the rear, the clamping force of claws is arranged to increase.

The rear end region of the pin holding portion 165 is connected with the front-end region of the screw shaft 45 via the connecting portion 166.

Thus, the pin holding portion 165 moves in the front-rear direction with the screw shaft 45.

Note that the connecting portion 166 comprises a penetration hole to communicate with the penetration hole of the drive shaft 450.

Hereinafter, the inner structure of the handle 17 is explained.

As shown in FIG. 4, the switch 172 (electrical switch) is housed in the handle 17 to closed to the rear side of the trigger 171.

When the switch 172 is turned on, specific signal (on-signal) is outputted to the controller 20.

(Forward Trip)

As shown in FIG. 4, in the initial position in which the trigger 171 is not pulled, the screw shaft 45 (drive shaft 450) and the pin holding portion 165 are disposed at the initial position.

User of the fastening tool 1 temporary setting one of the non-breaking typed fastener 9 (see FIG. 1) or the breaking typed fastener 9A (see FIG. 2) to the work piece W and then, insert the shaft portion 911 of the pin 91 to the front end region (claw) of the pin holding portion 165 and loosely hold by the small diameter portion 913.

Note that, as explained above, the user manually operates the operation dial 22 as to which the fastener 9 or the fastener 9A is used (see FIG. 4).

When the user pulls the trigger 171, the controller 20 (control substrate) starts the motor 21 based on the on signal from the switch 172 and thus, the motor 21 is started to forwardly rotate. Thus, the forward trip is started.

In the forward trip, the forward rotation of the motor shaft 213 is transmitted to the nut 41 via the planetary speed reduction mechanism 31, the drive gear 32 and the idling gear 33.

The screw shaft 45 and the pin holding portion 165 move rearward (in the first direction) to the tool housing 10 and the anvil 161 as the nut 41 rotates.

The shaft portion 911 of the pin 91 is strongly held by the pin holding portion 165 and pulled to rearward to the collar 95 and the work piece W.

(In a Case that Non-Breaking Typed Fastener is Used)

When the non-breaking typed fastener 9 as shown in FIG. 1 is used, the collar 95 is deformed and then, fastened to the shaft portion 911 of the pin 91. Thus, the work piece W is clamped between the head portion 915 and the collar 95. When the further deformation (plastic deformation) becomes impossible, the number of rotations of the motor 21 decreases. And then, when the number of rotations of the motor 21 becomes equal or less than the predetermined reference number of rotations, the motor 21 is stopped and thus, the forward trip is finished.

Note that, according to the fastening tool 1, when the non-breaking typed fastener 9 is used, the output control of the motor 21 is subject to the characteristic motor drive control mode. This aspect will be explained later.

(In a Case that Breaking Typed Fastener is Used)

On the other hand, when the breaking typed fastener 9A is used, the collar 95 is deformed and fastened by the shaft portion 911 of the pin 91 and then, the work piece W is clamped by the head portion 915 of the pin 91 and the collar 95. In this case, the shaft portion 911 is broken at the small diameter portion 913 and the pin tail is separated. Thus, the fastening operation of the work piece W is completed.

The controller 20 stops the forward drive of the motor 21 in relation to the screw shaft 45 and the pin holding portion 165 reaching the predetermined stopping position.

Specifically, in this embodiment, the controller 20 is arranged to detect the screw shaft 45 and the pin holding portion 165 reaching the stopping position based on the detection result of the second sensor 82. Namely, when the magnet 48 approaches from the front side to the second sensor 82 and the second sensor 82 is turned on (namely when LOW signal outputted from the second sensor 82 is detected), the controller decides that the screw shaft 45 and the pin holding portion 165 have reached the stopping position and then, the motor 21 is stopped. Thus, the forward trip is completed.

(Return Trip)

In a case that one of the non-breaking typed fastener 9 as shown in FIG. 1 and the breaking typed fastener 9A as shown in FIG. 2 is used, the controller 20 stars the reverse drive of the motor 21 in relation to turning off of the switch 172 by the user cancelling the push of the trigger 171. Thus, return trip is commenced.

As the motor shaft 21 reversely rotates, the nut 41 reversely rotates in the opposite direction to the forward trip.

Thereby, the screw shaft 45 and the pin holding portion 165 moves forward (the second direction) to the tool housing 10 and to the anvil 161.

The controller 20 stops the reverse drive of the motor 21 in accordance with the screw shaft 45 and the pin holding portion 165 reaching the initial position as shown in FIG. 4.

According to this embodiment, the controller is arranged to decide whether the screw shaft 45 and the pin holding portion 165 reach the initial position based on the detection result of the first sensor 81.

Specifically, when the magnet 48 approaches the first sensor 81 from rear side and the first sensor 81 is turned on (namely, the controller 20 receives LOW signal outputted from the first sensor 81), the controller 20 decides that the screw shaft 45 and the pin holding portion 165 reaches the initial position and then, stop the motor 21. As a result, the return trip is completed.

(Structure of the Motor Drive Control Mechanism 200)

FIG. 8 shows, as a block diagram, an electric structure of the motor drive control mechanism 200 of the fastening tool 100 according to this embodiment.

The motor drive control mechanism 200 is mainly provided with a controller 20, a three phases inverter 24 and a battery 145.

The controller 20 is a structural example of "controller" according to this disclosure.

The controller 20 is electrically connected with a first sensor 81 which defines an initial position sensor, a second sensor 82 which defines a rear end position sensor, and a drive current detecting amplifier 23 of the motor 21 and thus, a detecting signal is inputted.

Further, a LED light 25 is connected to the controller 20. The LED light 25 illuminates the working area and also informs the operator of completion of the fastening operation in accordance with the working process.

Note that the dive current detecting amplifier 23 transforms the dive current for the motor 21 to voltage by means of a shunt resistor and then, inputs the signal amplified by the amplifier to the controller 20.

Figure 9:
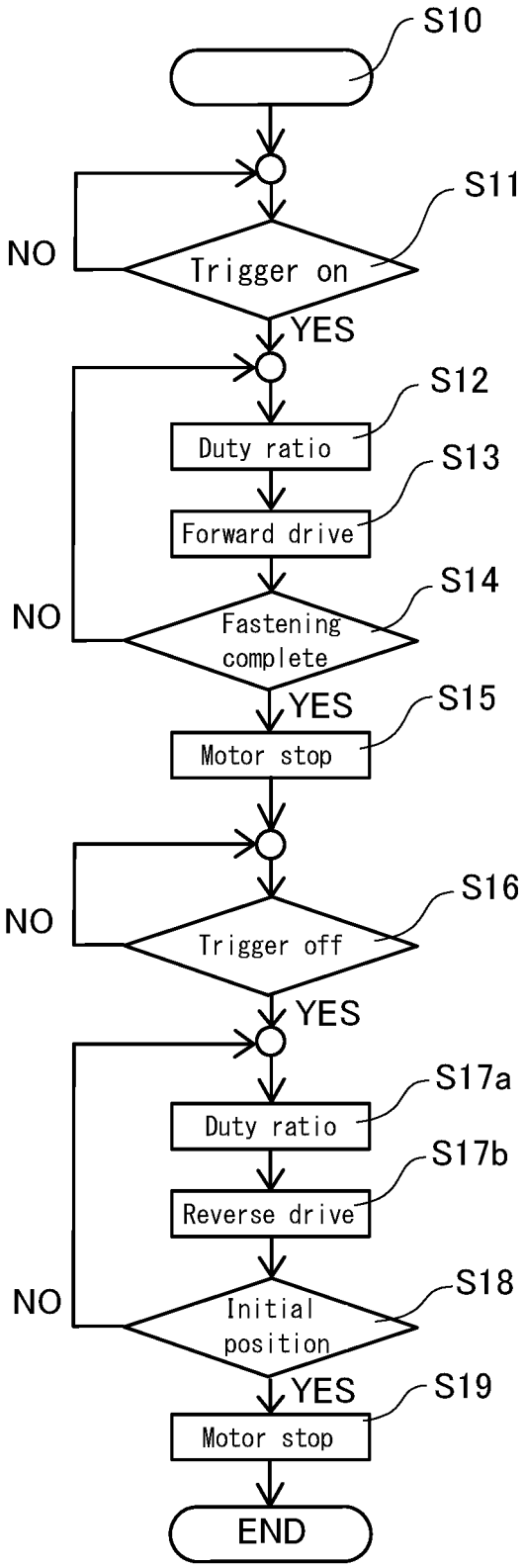
FIG. 9 shows a flow diagram indicating procedural steps at the motor drive control mechanism.

FIG. 9 shows an abstract of control flow in the motor drive control mode at the controller 20 (and also at motor drive control mechanism 200), which will be called as "motor drive control routine S10". Note that the decision in the motor drive control mode is made by the controller 20 unless specific notification is made. Further, numerical references in FIG. 1 to FIG. 8 as explained above are diverted (applied) as such to numerical references of component portions and accordingly, these numerical references are not specifically shown in FIG. 9.

(S11)

In step S10 as motor drive control routine, on-off state of the switch 172 by the trigger 171 is monitored in Step S11.

(S12)

Then, when on state of the switch 172 is detected, as step S12, duty ratio is calculated and PWM signal is generated in the three phased inverter 24 for driving the motor 21.

(S13)

Then, as step S13, the motor 21 is forwardly rotated.

According to this embodiment, as explained above, the motor 21 is controlled to be driven based on a predetermined motor drive control mode in a case that fastener 9 as shown in FIG. 1 which is defined as non-breaking typed fastener.

In this respect, such mode is hereinafter explained as "motor drive control mode based on current limit and electric power limit".

The forward driving of the motor 135 is corresponding to movement such that the screw shaft 45 as shown from FIG. 4 to FIG. 7 linearly moves in the rear direction (in the first direction) and the pin holding portion 165 moves in the rear direction with respect to the anvil 161.

(S14)

In Step S14, it is determined that:

(1) whether the fastening operation is completed such that the number of rotations of the motor 21 is equal or less than the predetermined reference number of rotations as explained above, or (2) whether the magnet 48 reaches the second sensor 82 which defines the rear end position sensor. The determination based on the number of rotations of the motor 21 is, typically, corresponding to a control mode in case that non-breaking typed fastener as shown in FIG. 1 is used. Further, the determination based on the detection of the rear end position is corresponding to a control mode in case that breaking typed fastener as shown in FIG. 2 is used.

While the reference number of rotations for the motor 21 is set to a predetermined number of rotations in this embodiment, it may embrace zero revolution, namely an aspect that the motor 21 is stopped.

Note that, in a case that the non-breaking typed fastener 9 is used, it may possibly occur that the rear end position is detected before the number of rotations of the motor 21 is equal or less than the predetermined reference number of rotations. In such a case, the determination based on the rear end position is done even in the use of the non-breaking typed fastener 9.

(S15)

In Step S14, when the completion of the fastening operation is detected, or the rear end position is detected, the motor 135 is stopped in Step 15.

Note that, while it is not specifically shown in the flow chart, the LED 25 is illuminated by means of the controller 20 to inform the user of completion of the fastening operation.

Form (S16) to (S19)

Next, in step S16, in a case that the off-signal of the switch 172 based on the off-operation of the trigger by the user is detected, calculation of Duty ratio and generation of PWM signal for reversely drive the motor 21 in step S17*b* and thus, the motor 21 is reversely driven.

As it is explained above, the reverse drive of the motor 21 is conducted by controlling the motor to drive by a predetermined number of rotations. Such reverse drive of the motor 21 is continued till the time that the magnet 48 reaches the first sensor 81 which defines the initial position sensor. Then, according to the detection of the initial position in step S18, the motor 21 is stopped by an electric brake (Step S19) and the motor drive control mode is completed.

(Block Diagram of the Motor Drive Control)

Figure 10:
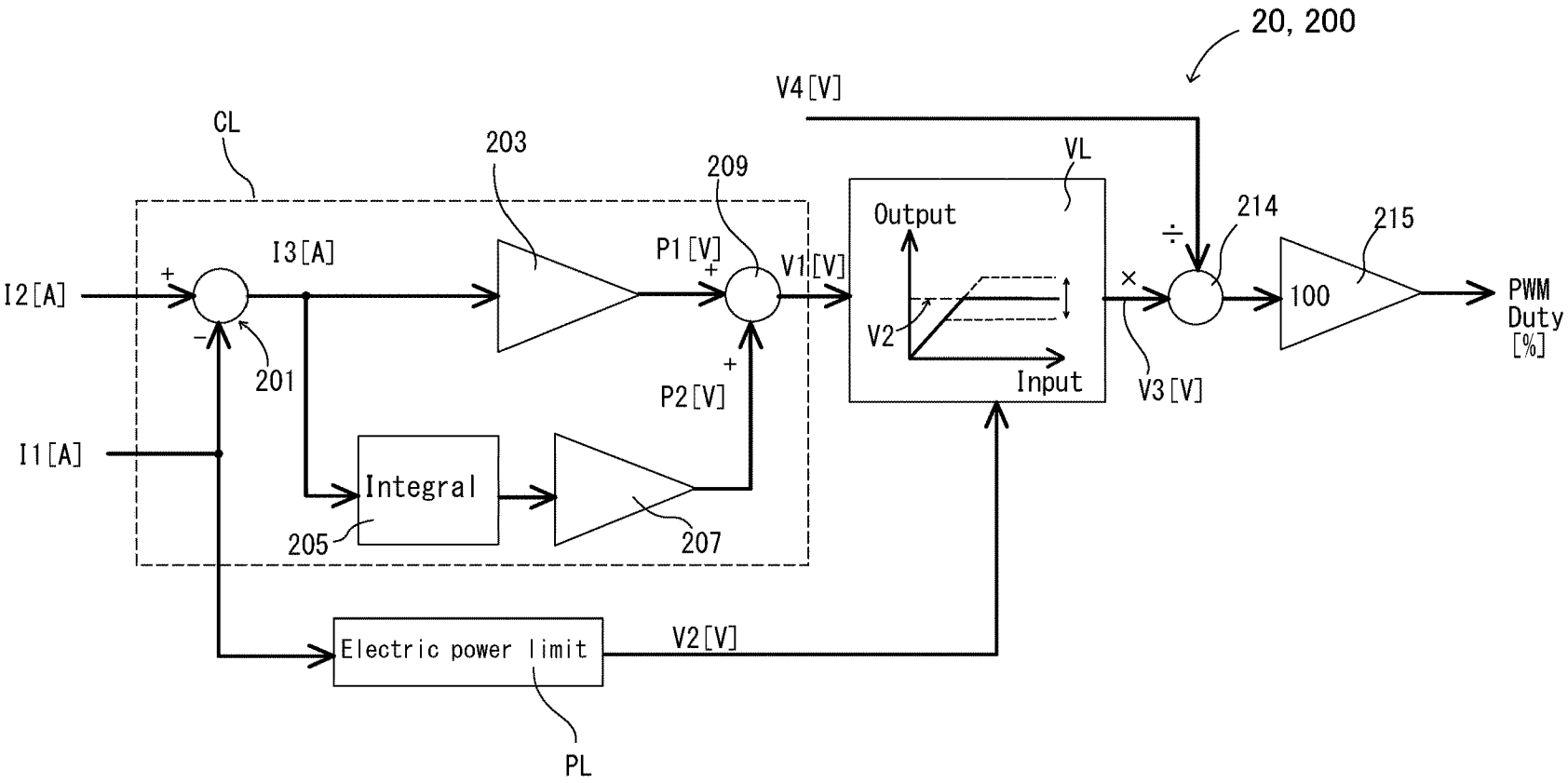
FIG. 10 shows a block diagram indicating procedural aspects by the motor drive control mode.

Next, in a case that the non-breaking typed fastener 9 (see FIG. 1) is used in the motor forward drive, "motor drive control mode based on current limit and electric power limit" is explained in accordance with FIG. 10 showing a block diagram of the motor drive control.

Note that procedures in this motor drive control mode are conducted by processing elements in the controller 131 as shown in FIG. 8 (and/or by the three phases inverter 134).

(Current Limit Control 1: P-Gain Control)

First, procedure at the current limit control part CL with respect to the drive current of the motor 21.

As shown in FIG. 10, current difference value I3 (unit is ampere: A) is provided by adding motor drive current value I1 as minus value with current limit value I2 (unit is ampere: A) as plus value at the adding point 201 (also referred as "summing point").

P-gain (proportional gain) procedure is made to the current difference value I3 at the amplifier 203 which defines a proportional element and the, P-output value P1 (proportional output) as voltage value (unit is voltage: V) is generated.

(Current Limit Control 2: I-Gain Control)

On the other hand, with respect to the current difference value I3, I-output value P2 as (integral) voltage value (unit is voltage: V) is provided by being integrally processed at the integral processing portion 205 and by I-gain processed at the amplifier 207 (Integral gain)

The P-output value P1 and the I-output value P2 are added at the adding point 209 and thus, voltage output value V1 (unit is voltage: V) is generated as P & I output. The voltage output value V1 is corresponding to so-called PI action in a control system so as to have adjustment function of the steady-state deviation.

The voltage output value V1 defines voltage output value after the current limit process and one example of "second reference value" and "first voltage output value" according to this disclosure. Then, the voltage output value V1 is transmitted to the voltage limit control part VL.

(Character of the Current Limit Control)

As explained above, as a result of the current limit control the voltage output value V1 defines reference of the voltage value corresponding to the motor drive current value with an upper limit of current limit value I2.

In other words, the mode is prevented from generating motor drive current values which exceeds predetermined current limit value I2.

(Electric Power Limit Control)

Further in this embodiment, as shown in FIG. 10, limit control of the drive power is made to the motor drive current value I1 at the electric power limit control part PL.

Specifically, in the electric power limit control part PL, predetermined electric power limit value PW1 (unit is watt: W) is divided by the motor drive current value I1 and as a result, voltage limit value V2 (unit is voltage: V) is outputted.

Namely, the voltage limit value V2 is calculated by the equation "V2=PW1(W)/I1 (A)". In other words, V2 is calculated by dividing PW1 by I1.

The voltage limit value V2 is a threshold as voltage value corresponding to limit value for suppression control (inhibit control) of the driving electric power of the motor 21 so as to correspond to the "second limit value" according to this disclosure.

The calculated voltage limit value is sent to the voltage limit control part VL.

(Voltage Limit Control Output)

In the voltage limit control part VL, the voltage output value V1 outputted from the above-explained current limit control part CL is compared with the voltage limit value V2 outputted form the electric power limit control part PL.

In a case that the voltage output value V1 is greater than the voltage limit value V2, the output value is adjusted such that the voltage limit value V2 is to be the voltage value V3 after the electric power limit procedure.

On the other hand, in a case that the voltage output value V1 is equal to or smaller than the voltage limit value V2, the voltage output value V1 is not adjusted to change. Thus, the voltage output value V1 is to be the voltage value V3 after the electric power limit procedure.

In other word, in the voltage limit control part VL, both voltage values are compared and substantially, electric power value corresponding to the motor drive current value I1 is adjusted to be outputted not to exceed the predetermined electric power limit value PW1. This is, according to this embodiment, the adjustment is done by utilizing voltage value.

(Calculation of the PWM Duty Ratio)

Thus, the voltage value V3 (unit is volt: V) after the electric power limit procedure is outputted as compared with the voltage limit value V2 in the voltage limit control part VL and the, sent to the adding potin 214.

At the adding point 214, proportional calculation procedure is made to the voltage value V3 after the electric power limit procedure with respect to electric source voltage value V4 (unit is volt: V).

After that, the voltage value V3 is transformed to percentage at the amplifier 214 and then, PWM duty ratio to drive the motor 21 is calculated. And then, PWM signal is generated based on the PWM duty ration and the motor 21 as a brushless motor is driven.

(Chronological Change Over Time of Each Parameter in the Motor Drive Control Mode)

Figure 11:
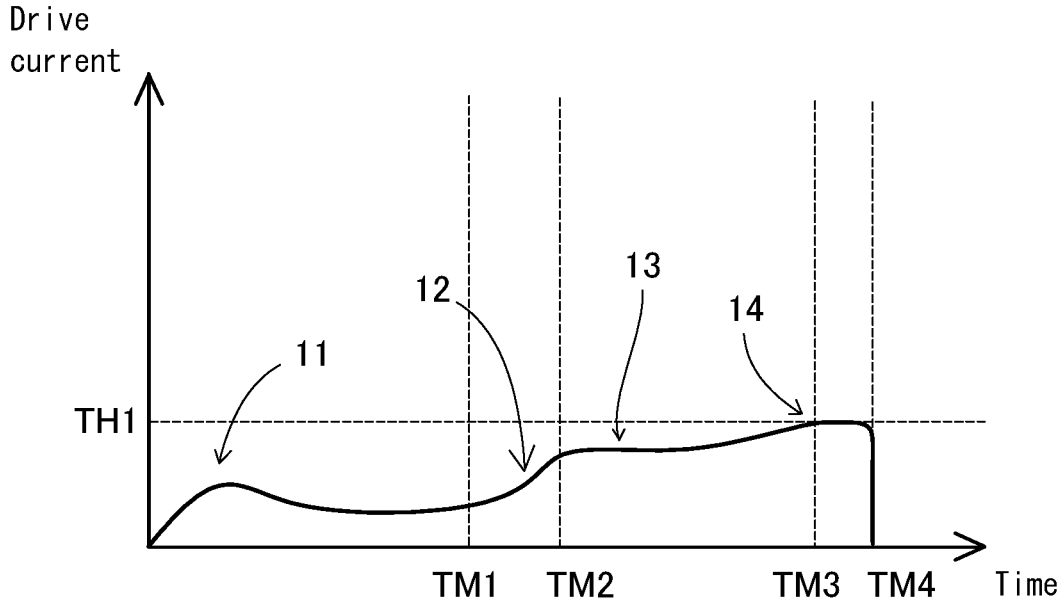
FIG. 11 shows a graph indicating the change by time of the motor drive current.
Figure 12:
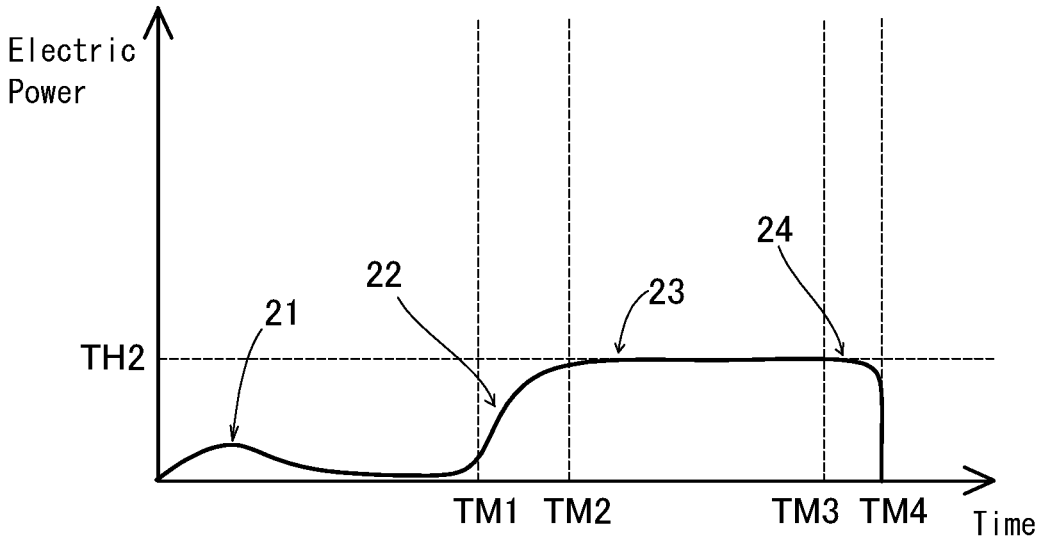
FIG. 12 shows a graph indicating the change by time of the electric power to drive the motor.
Figure 13:
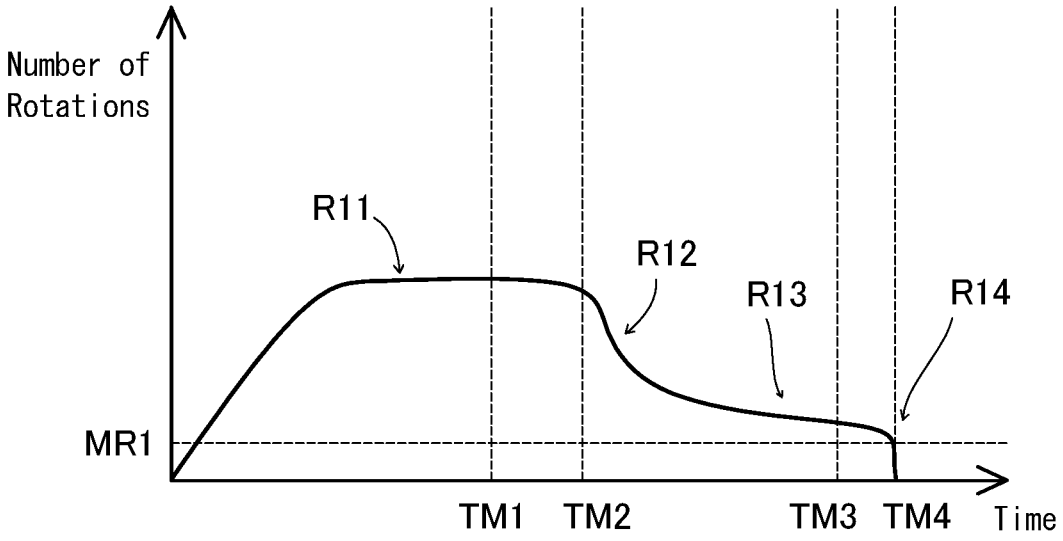
FIG. 13 shows a graph indicating the change by time of the number of rotations of the motor.

With respect to the motor drive control mode as explained above, namely the limit control of the drive current of the motor 21 and the limit control of the drive power), FIG. 11, FIG. 12 and FIG. 13 respectively schematically show chronological changes over time of the drive current value of the motor 21, electric power value and number of rotations of the motor 21.

Note that, in this embodiment, each control parameter is represented by corresponding voltage value both for the current limit control and the electric power limit control.

In other words, as to the drive current value and the electric power value of the motor 21 is processed by utilizing respectively corresponding voltage values at the motor drive control mechanism 200.

On the other hand, for the sake of precisely clarifying the technical character of this disclosure, FIG. 11 and FIG. 12 is explained by utilizing chronological change of the drive current value and the electric power value of the motor 21 instead of the voltage value.

FIG. 11 shows a graph in which the vertical axis represents the drive current value of the motor 21 (drive current value corresponding to the voltage value V3 after the power limit control), as well as the horizontal axis represents time passage.

TH1 on the vertical axis corresponds to current limit value 12 regarding the drive current of the motor 21 (see FIG. 10).

TM1 on the horizontal axis corresponds to loaded drive start time or to load start time. The loaded drive start time defines the time when the collar 95 of the fastener 9 (see FIG. 1) contacts the anvil 161 to stop (see FIG. 4) and the fastening operation starts.

TM2 corresponds to time when the electric power limit control by the above-explained electric power limit control part PL and the voltage limit control part VL (both see FIG. 10) starts.

TM3 corresponds to time when the above-explained current limit control by the current limit control part CL (also see FIG. 10) starts.

TM4 corresponds to time when the motor 21 is controlled to stop as completion of the fastening operation when the number of rotations of the motor 21 is less than the predetermined reference number of rotations (also see Step S15 in FIG. 9).

FIG. 12 shows a graph in which the vertical axis represents the electric power value to drive the motor 21 (electric power value corresponding to the voltage value V3 after the power limit control), as well as the horizontal axis represents time passage.

TH2 on the vertical axis represents electric power limit value corresponding to the drive current limit value V2 (see FIG. 10).

Note that while FIG. 12 is graph which shows the relation between the electric power value and the time passage, as is already explained in FIG. 10, the motor drive control mechanism conducts the control based on the voltage value and in this conjunction, FIG. 12 is schematically shown only for the sake of convenience of the explanation.

The meaning of TM1 to TM4 on the horizontal axis of FIG. 12 respectively the same with TM1 to TM 4 in FIG. 11.

FIG. 13 shows a graph in which the vertical axis represents the number of rotations MR of the motor 21 (unit: r.p.m. (revolution per minute)), as well as the horizontal axis represents time passage.

MR1 on the vertical axis in FIG. 13 corresponds to the reference number of rotations of the motor 21 as a reference to decide the completion of the fastening operation.

The meaning of TM1 to TM4 on the horizontal axis of FIG. 12 respectively the same with TM1 to TM 4 in FIG. 11.

Note that the number of rotations MR of the motor 21 can be replaced by any other parameter which is in relation to the number of rotations MR. For example, component member of the drive mechanism 3 (see FIG. 4) driven by the motor 21, drive current value of the battery 145 to drive the motor 21 and so on can be used.

(Start of the Limit Control of the Motor Drive Current)

In the step S11 as shown in FIG. 9, when the on-state of the switch 172 based on the operation of the trigger 171 is detected, limit control of the motor drive current is done such that the drive current I11 of the motor 21 is equal or less that the current limit value I2 in the step S12.

Corresponding to this control, as shown in FIG. 11, relatively large starting current is generated in the initial stage of starting the motor 21 (Region 11 in FIG. 11), the current does not reach the current limit value TH1 (namely I2) and therefore not control based on the current limit value TH1 is done.

In this state, the motor drive current value is less than 12 in FIG. 10, the voltage output value V1 is not controlled to be limited. As a result, the voltage output value V1 is outputted so as to correspond to the motor drive current value I1 and then, transmitted to the voltage limit control part.

Further, as shown in FIG. 12, because relatively large starting electric power is generated as relatively large starting current is generated in the early stage of starting the motor 21 (region 21 in FIG. 21), such electric power does not reach the electric power limit value TH2. Therefore, no limit control based on the electric power limit value TH2 is done.

Further in this state, as shown in FIG. 13, the number of rotations MR of the motor 21 increases as the drive current value I1 increases and then, the rotation of the motor 21 is stably maintained (region R11 in FIG. 13).

(Load Start)

After the start, as shown in FIG. 11, the drive current value I1 increases from TM1 which corresponds to the load start time for initiating the fastening operation (the region 12 in FIG. 11). On the other hand, as the drive current value Il increases, the electric power value to drive the motor 21 also increases (the region 22 in FIG. 12).

The electric power limit value TH2 as explained above is set as a limiting value not to allow generation of electric power which exceeds the electric power limit value TH2.

Therefore, when the electric power valued reaches the electric power limit value TH2 (at the time TM2 in FIG. 12), the electric power limit control is done and the electric power value after the time TM2 is limited to the limit value TH2 (the region 23 in FIG. 12). This is, in FIG. 10, the voltage limit value V2 is calculated in the electric power limit part PL, as well in the electric power limit control part PL in FIG. 10, the voltage output value V1 reaches the voltage limit value V2 and thereafter, is limited to the voltage limit value V2.

As shown in FIG. 12, after the time TM2, the electric power value is controlled no to exceed the limit value TH2 and thus, the electric power is maintained to the limit value TH2 (the area from the region 23 to the region 24 in FIG. 12).

In this case, as the electric power value is controlled, the motor drive current value is also controlled as shown in FIG. 11 so as not to reach the current limit value TH1 (the region 13 in FIG. 11).

As the electric power value and the motor drive current value are limited, the number of rotations MR of the motor 21 is, as shown in FIG. 13, kept relatively low value (the region from R12 to R13 in FIG. 13).

In other words, the number of rotations of the motor 21 is kept at relatively low, while total time necessary for completing the fastening operation is relatively long, dynamic inertial force generated by the rotation of the motor 21 can be kept relatively at low.

(Development and Termination of the Fastening Operation)

As the fastening operation proceeds, the necessary torque relatively increases. As shown in FIG. 11, as the time flows from TM2 to TM3, the motor drive current value growingly increases and reaches the current limit value TH1 at the time TM3 (region 14 in FIG. 11).

As a result, the motor drive current value is limited to the current limit value TH 1 till to the time TM4.

In such a case, because the motor drive current value is limited, the electric power value is, as shown in FIG. 12, also limited from the time TM3 to the time TM4 (region 24 and thereafter in FIG. 12).

(Improvement of Protectability of the Apparatus According to this Embodiment)

As shown in FIG. 13, because the motor drive current value is limited, the number of rotations MR of the motor 21 decreases till the time TM4.

As explained above, the electric power limit control is already done at the time TM2 according to this embodiment and the number of rotations MR of the motor 21 is controlled to be limited to relatively decrease from the time TM2 to TM4 via the time TM3.

Therefore, when the rotation numbers MR of the motor 21 falls below the reference number of rotations MR1 of the motor 21 at the time TM4 to terminate the fastening operation by stopping to the rotation of the motor 21, dynamic inertial force of the rotating component members of the motor 21 is kept relatively low and thus, stopping shock of the motor 21 can be effectively alleviated.

(Comparison with Conventional Fastening Tool Without the Electric Power Limit Control)

As is explained above, this embodiment improves protectability of the apparatus by conducting limit controls both of the motor drive current value and the electric power and thereby, precisely controlling the output management of the fastening operation for the non-breaking typed fastener 9 as shown in FIG. 1.

Figure 14:
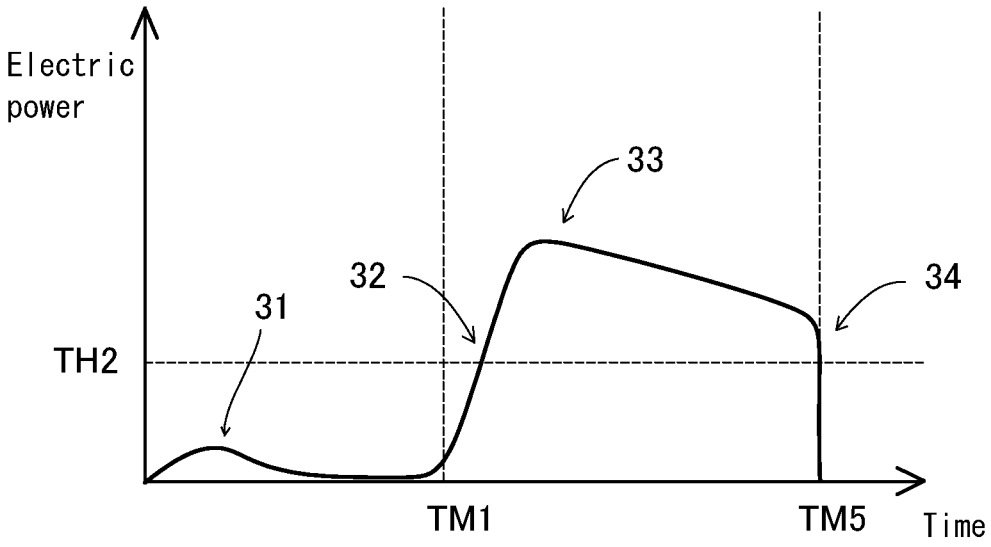
FIG. 14 shows a graph indicating the change by time of the electric power to drive the motor according to the prior art.

On the other hand, if so-called conventional typed motor drive limit control only with limit control of the motor drive current value is used, the time transition of the electric power for driving the motor 21 is shown in FIG. 14.

Namely in FIG. 14, because the electric power limit value TH2 as explained in FIG. 12 is not provided, the electric power value remarkably increases at and after the time TM1 when the fastening operation is started (regions 32, 33 in FIG. 14). And relatively high electric power is maintained till the time TM 5 when the fastening operation is terminated.

Figure 15:
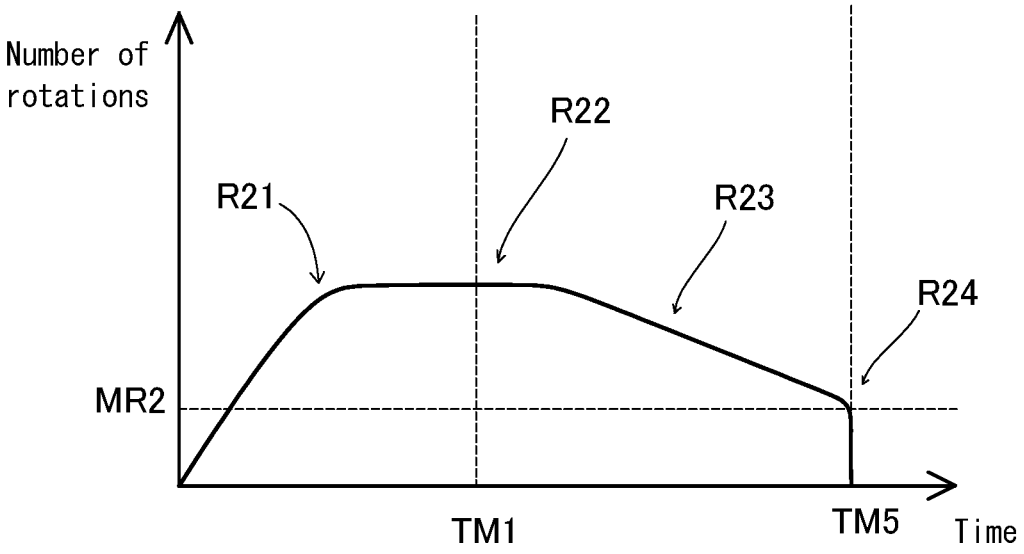
FIG. 15 shows a graph indicating the change by time of the number of rotations of the motor according to the prior art.

Therefore, as shown in FIG. 15, the number of rotations MR of the motor 21 remains relatively high in comparison with the state in FIG. 13 till the time TM5 when the fastening operation is terminated and as such, the motor is stopped by reaching the reference number of rotations MR2 (Regions from R21, R22, R23 to R24 in FIG. 15).

The relatively high number of rotations MR of the motor 21 enables the necessary time for the fastening operation relatively fast, working efficiency can be enhanced.

On the other hand, when the non-breaking typed fastener 9 as shown in FIG. 1 is fastened, it is necessary to stop the motor driven with relatively high number of rotations in stopping the motor drive to complete the fastening operation.

In other words, the reference number of rotations MR2 in FIG. 15 is relatively higher than the reference number of rotations MR1 in FIG. 13.

In this regard, relatively high dynamic inertial force during the rotation of the motor may adversely affect the apparatus when the motor is stopped.

In this embodiment, the number of rotations of the motor 21 can be maintained at relatively low by both the limit controls of the motor drive current and the electric power. As a result, adverse affection of inertial force of the motor 21 to the apparatus can be alleviated in the case that the motor 21 is stopped to complete the fastening operation.

As to the fastening tool 1, high load may possibly be applied to a holding claw portion (also referred to as "Puller") in order to generate strong fastening force.

This becomes problematic especially in a case to use non-breaking typed fastener 9 as shown in FIG. 1.

In the non-breaking typed fastener 9, the end region 916 of the shaft portion 911 is remained integral with the shaft portion 911 when the fastening operation is completed. In this regard, the completion of the fastening operation is detected by a status that further plastic deformation of the fastener 9 becomes impossible and resultantly, the number of rotations of the motor remarkably decreases or stops (see step S14 in FIG. 9).

According to this embodiment, both by the limit controls of the motor drive current and the electric power, the number of rotations of the motor 21 can be maintained relatively at low and thus, the reference number of rotations for deciding the completion of the fastening operation can be set at low level (namely, MR1<Mr2).

Therefore, when motor 21 is stopped to complete the fastening operation (namely when the outward trip is finished), the dynamic inertial force of the motor 21 can be decreased to alleviate the stopping shock of the motor 21 so as to improve the protectability of the apparatus including the pin holding portion 165.

As explained above, in this embodiment, while the number of rotations of the motor 21 is maintained at relatively low, the working time for competing the fastening operation takes relatively long. On the other hand, as trade-off with this long working time, the dynamic inertial force of the motor 21 can relatively be decreased to improve the protectability of the apparatus.

In this respect, having regard to a viewpoint of focusing on shortening the working time, it can be arranged such that electric power limit control is not done till predetermined time passes from staring the motor 21 and thereafter, both limit controls of the motor drive current and the electric power are applied. As a result, till the predetermined time of the outward trip, the motor 21 is driven at relatively high speed. And then, the motor 21 is driven at relatively low speed when the fastening operation comes to nearing the end in order to alleviate the dynamic inertial force.

Specifically, following aspect is provided:

"The bolt holding portion is moved in the first direction by the above-explained motor drive limit control mode at least just before the completion of the fastening operation"

or

"The bolt holding portion is moved in the first direction by the above-explained motor drive limit control mode after predetermined time passes from the start of the fastening operation".

By each construction, the number of rotations of the motor 21 is driven at relatively high speed after the start of the fastening operation of the fastener 9 so as to shorten the working time, and then, the number of rotations of the motor 21 is driven at relatively low speed after the predetermined time passes or just before the completion of the fastening operation so as to improve the apparatus protectability.

On the other hand, it may possibly occur such that relatively strong fastening force is required or that the motor drive control according to this embodiment is required in a relatively early stage in order to protect apparatus due to relatively strong drive current and/or electric power in the early stage from the start of the fastening operation.

In this respect, following aspect is provided:

"The pin holding portion is driven by the motor drive control mode from the start of fastening the fastener 9 till to the end of the fastening operation"

or

"The pin holding portion is driven by the motor drive control mode in a case that the user operates the trigger to turn on till the end of the fastening operation".

Further, the fastening tool 1 according to this embodiment is arranged as a "dual use device" in which non-breaking typed fastener 9 as shown in FIG. 1 and breaking-typed fastener 9A are selectively applicable.

In the above-explained description, only the structure regarding the outward trip in a case that the non-breaking typed fastener 9 is described with respect to the drive current limit control and the electric power limit control. On the other hand, following aspect is provided:

"The fastening tool can also conduct fastening operation to the fastener having the collar and the head portion in which the end region of the shaft portion is separated from the shaft portion when the fastening operation is completed, wherein the controller has the holding portion move in the first direction to perform the fastening operation by using the motor drive control mode to control the drive of the motor based on the motor drive current and the electric power."

Otherwise, following aspect is provided:

"In a case that the fastening operation is completed, the pin holding portion relatively moves to the anvil in a second direction which is opposed to the first direction in the longitudinal direction to move back to the initial position, wherein the controller have the holding portion move in the second direction by said motor drive control mode with respect to the return trip".

Note the above-explained embodiment is only an example. The fastening tool according to this disclosure is not limited to the structure of the fastening tool 1 exampled in this embodiment. For example, following non-restrictive modifications can be provided. At least one of these modifications can be combined with at least one of the structures of the fastening tool 1 and/or one of the structures according to the claims.

The fastening tool 1 can use another typed fastener than the fastener 9 exampled in the embodiment. For example, blind rivet can be used to fasten the working material W.

The fastening tool 1 can be arranged to be applicable further to multiple types of fasteners by exchanging the anvil 161 and the pin holding portion 165. The shapes, component elements and connecting aspect of the tool body 10, nose 16 and the handle 17 can be selectively changed.

The drive mechanism 3 is required at least to have the pin holding portion 165 move to the anvil 161 in the front-rear direction and component elements and disposition can be selectively changed. For example, feed screw mechanism with a nut and screw shaft directly screwable can be adopted instead of the ball screw mechanism 40.

Further, the ball screw mechanism 40 can be structured such that the screw shaft 45 is rotatably held in a substantially non-movable manner in the front-end direction, while the nut 41 can move in the front-rear direction according to the rotation of the screw shaft 45.

In this case, the pin holding portion 165 is only required to be connected directly or indirectly to the nut 41.

Further, another typed gear train than the above-explained embodiment can be used to transmit the driving force from the motor 21 to the ball screw mechanism 40.

The control circuit of the controller 20 can be arranged by using any programmable logic device such like, for example, ASIC (Application Specific Integrated Circuits) or FPGA (Field Programmable Gate Array) instead of the microcomputer.

EXPLANATION OF REFERENCE NUMBERS

1 Fastening tool,
10 Tool housing,
102 Metal housing, 103 Barrel portion, 104 Holding portion, 105 screw opening,
107 Resin housing, 108 Opening, 109 Eye bolt,
12 Housing part
121 Guide plate, 123 Guide groove, 125 support rib, 13 Extending portion
14 Battery holding portion, 141 Battery holder, 15 Collecting container, 16 Nose
161 Anvil, 162 Connecting portion, 163 Connecting portion, 165 Pin holding portion,
166 Connecting portion,
17 Handle, 171 Trigger, 172 Switch, 18 Auxiliary handle,
145 Battery, 20 Controller, 200 Motor drive control mechanism

201 Adding point, 203 Amplifier, 205 Integral processing portion, 207 Amplifier,
209 Adding point, 211 Output limiter processing portion, 214 Adding point, 215 Amplifier
21 Motor, 213 Motor shaft, 219 Hole sensor,
22 Operation dial, 23 Drive current detecting amp, 24 Three phase inverter,
25 LED light
21 Drive mechanism, 31 Planetary speed reduction mechanism, 32 Drive gear, 33 Idling gear,
40 Ball screw mechanism, 41 nut, 411 Driven gear, 45 screw shaft,
450 Drive shaft, 451 Extended shaft, 46 Bearing holder,
461 Base portion, 462 Screw hole, 463 Arm portion, 465 Bearing,
47 Magnet holder, 471 Penetration hole, 475 Screw, 48 Magnet,
8 Position detecting mechanism, 80 Magnet sensor, 81 First sensor (Initial position sensor),
82 Second sensor (Rear end position sensor), 86 First substrate, 87 Second substrate,
9, 9A Fastener
91 Pin, 95 Collar, 911 Shaft portion, 913 Small diameter portion, 915 Head portion, 916 End part region,
CL Current limit control part,
PL Electric power limit control part
VL Voltage limit control part (after the electric power limit control)
P1 P-output, I1-output,
I1 Motor drive current value (First reference value),
I2 Current limit value (first upper limit value),
I3 Current difference
PW1 Electric power limit value,
V1 Voltage output value after the current limit procedure (Second reference value, First voltage output value)
V2 Voltage limit value based on the electric power limit procedure (Second upper limit value)
V3 Voltage value after the electric power limit procedure (Second voltage output value)
V4 Electric source voltage value (Battery voltage value)
MR Motor rotations number (Number of rotations of the motor)
PW Electric power reference value (Voltage output)
A1 Drive shaft, A2 Rotation shaft, A3 Movement shaft
W, W1, W2 Work pieces

**********

What is claimed is:

1. A fastening tool which fastens a work piece by utilizing a fastener that includes a pin including a shaft portion and a head portion that are integrally formed, and a hollow shaped collar which is engageable to the pin, the work piece being disposed between the head portion and the collar, the fastening tool comprising:

a pin holding portion which can hold an end part region of the shaft portion, an anvil, a motor that is configured to drive the pin holding portion to move the pin holding portion relatively to the anvil in a predetermined longitudinal direction, and a controller that is configured to conduct drive control of the motor, wherein in a state in which the pin holding portion holds the end part region of the shaft portion, the pin holding portion is configured to relatively move to the anvil in a predetermined first direction of the longitudinal direction and the anvil is configured to push the collar engaged with the shaft portion to fasten the fastener, wherein the fastener is configured to be fastened in a state that the collar and the head portion clamp the work piece and the end part region is integral with the shaft portion, wherein the controller is configured to drive the pin holding portion to move in the first direction to conduct the fastening of the fastener by a motor drive control mode defined as a drive control of the motor based on motor drive current and motor drive electric power such that (i) a first reference value regarding the motor drive current is equal to or less than a predetermined first upper limit value, and (ii) a second reference value regarding the motor drive electric power is equal to or less than a predetermined second upper limit value, and wherein the second upper limit value is set to correspond to an inertia force of the motor in the fastening operation.

2. The fastening tool as defined in claim 1, wherein at least one of the first upper limit value and the second d upper limit value is changeable by a manual operation of the user.

3. The fastening tool as defined in claim 1, wherein the controller is configured to drive the pin holding portion by the motor drive control mode from the start of the fastening operation to the completion of the fastening operation.

4. The fastening tool as defined in claim 1, wherein the controller is configured to drive the pin holding portion by the motor drive control mode from the start of the fastening operation until a predetermined time passing.

5. The fastening tool as defined in claim 1, wherein, if the state of the pin holding portion before moving in the first direction is defined as an initial position, the controller is configured to drive the pin holding portion to move back to the initial position in a return trip after completion of the fastening operation, and wherein, in the return trip, the motor drive control mode is not applied for the motor drive.

6. The fastening tool as defined in claim 1, wherein the controller is configured to stop the driving of the pin holding portion in a case that a reference regarding a number of rotations of the motor is equal to or less than a predetermined value to complete the fastening operation.

7. The fastening tool as defined in claim 1, wherein, when the fastener is defined as a first fastener, the fastening tool is further configured to fasten a work piece by utilizing a second fastener, which is different from the first fastener, wherein the second fastener comprises a second pin including a second shaft portion and a second head portion that are integrally formed, and a second hollow shaped collar which is engageable to the second pin, wherein a second end part region of the second shaft portion is separatable from the second shaft portion, wherein the fastening tool can fasten a work piece disposed between the second head portion and the second collar, and wherein, the pin holding portion is configured to conduct the fastening of the second fastener in a state in which the second end part region is separated from the second shaft portion.

8. The fastening tool as defined in claim 1, wherein the second upper limit value is set to correspond to the inertia force of the motor to cause a number of rotations of the motor to be below a predetermined reference number of rotations when the motor is stopped.

9. A fastening tool which fastens a work piece by utilizing a fastener that includes a pin including a shaft portion and a head portion that are integrally formed, and a hollow shaped collar which is engageable to the pin, the work piece being disposed between the head portion and the collar, the fastening tool comprising:

a pin holding portion which can hold an end part region of the shaft portion, an anvil, a motor that is configured to drive the pin holding portion to move the pin holding portion relatively to the anvil in a predetermined longitudinal direction, and a controller that is configured to conduct drive control of the motor, wherein in a state in which the pin holding portion holds the end part region of the shaft portion, the pin holding portion is configured to relatively move to the anvil in a predetermined first direction of the longitudinal direction and the anvil is configured to push the collar engaged with the shaft portion to fasten the fastener, wherein the fastener is configured to be fastened in a state that the collar and the head portion clamp the work piece and the end part region is integral with the shaft portion, wherein the controller is configured to drive the pin holding portion to move in the first direction to conduct the fastening of the fastener by a motor drive control mode defined as a drive control of the motor based on motor drive current and motor drive electric power, wherein the controller is configured to conduct the drive control of the motor in the motor drive control mode such that (i) a first reference value regarding the drive current of the motor is equal to or less than a predetermined first upper limit value, and (ii) a second reference value regarding the motor drive electric power is equal to or less than a predetermined second upper limit value, and wherein the controller is configured to calculate the first reference value and the second reference value as voltage values.

10. A fastening tool which fastens a work piece by utilizing a fastener that includes a pin including a shaft portion and a head portion that are integrally formed, and a hollow shaped collar which is engageable to the pin, the work piece being disposed between the head portion and the collar, the fastening tool comprising:

a pin holding portion which can hold an end part region of the shaft portion, an anvil, a motor that is configured to drive the pin holding portion to move the pin holding portion relatively to the anvil in a predetermined longitudinal direction, and a controller that is configured to conduct drive control of the motor, wherein in a state in which the pin holding portion holds the end part region of the shaft portion, the pin holding portion is configured to relatively move to the anvil in a predetermined first direction of the longitudinal direction and the anvil is configured to push the collar engaged with the shaft portion to fasten the fastener, wherein the fastener is configured to be fastened in a state that the collar and the head portion clamp the work piece and the end part region is integral with the shaft portion, wherein the controller is configured to drive the pin holding portion to move in the first direction to conduct the fastening of the fastener by a motor drive control mode defined as a drive control of the motor based on motor drive current and motor drive electric power, wherein the controller is configured to conduct the drive control of the motor in the motor drive control mode such that (i) a first reference value regarding the drive current of the motor is equal to or less than a predetermined first upper limit value, and (ii) a second reference value regarding the motor drive electric power is equal to or less than a predetermined second upper limit value, wherein the controller is configured to calculate a first voltage output value with respect to the motor drive current such that the first reference value is equal to or less than the first upper limit value so as to set the second reference value based on the first voltage output value, and wherein the controller is configured to calculate the second upper limit value as a voltage value based on the motor drive current so as to control the motor drive such that the second reference value is equal to or less than the second upper limit value.

11. The fastening tool as defined in claim 10, wherein the motor is defined by a blushless motor, and wherein the controller is configured to:

calculate a second voltage output value such that the second reference value is equal to or less than the second upper limit value, and calculate a PWM duty ration to drive the motor based on the second voltage output value.

* * * * *